US010309736B2

(12) United States Patent
Warburton et al.

(10) Patent No.: US 10,309,736 B2
(45) Date of Patent: Jun. 4, 2019

(54) SHELL LOADING SYSTEM FOR FIREARM

(71) Applicant: Sturm, Ruger & Company, Inc., Southport, CT (US)

(72) Inventors: Scott Warburton, South Acworth, NH (US); Bruce Rozum, North Sutton, NH (US); Jason Pittman, North Salt Lake, UT (US)

(73) Assignee: Sturm, Ruger & Company, Inc.

( * ) Notice: Subject to any disclaimer, the term of this patent is extended or adjusted under 35 U.S.C. 154(b) by 66 days.

(21) Appl. No.: 15/710,606

(22) Filed: Sep. 20, 2017

(65) Prior Publication Data

US 2018/0023907 A1 Jan. 25, 2018

Related U.S. Application Data

(63) Continuation-in-part of application No. 14/703,164, filed on May 4, 2015, now Pat. No. 9,803,940.

(60) Provisional application No. 61/987,526, filed on May 2, 2014.

(51) Int. Cl.

| | |
|---|---|
| ***F41A 3/28*** | (2006.01) |
| ***F41A 3/58*** | (2006.01) |
| ***F41A 3/66*** | (2006.01) |
| ***F41A 9/18*** | (2006.01) |
| ***F41A 9/64*** | (2006.01) |
| ***F41A 21/00*** | (2006.01) |

(52) U.S. Cl.

CPC ..... *F41A 3/28* (2013.01); *F41A 3/58* (2013.01); *F41A 3/66* (2013.01); *F41A 9/18* (2013.01); *F41A 9/64* (2013.01); *F41A 21/00* (2013.01)

(58) Field of Classification Search

CPC ..... F41A 3/28; F41A 3/66; F41A 3/58; F41A 9/18; F41A 6/64; F41A 21/00

USPC ..... 42/17

See application file for complete search history.

(56) References Cited

U.S. PATENT DOCUMENTS

| | | | | |
|---|---|---|---|---|
| 2,278,589 A | | 4/1942 | Rutherford | |
| 2,418,946 A | * | 4/1947 | Loomis | F41A 3/40 42/16 |
| 2,586,509 A | | 2/1952 | Browning | |
| 2,592,858 A | | 4/1952 | Clarkson | |
| 2,575,638 A | | 4/1954 | Ray | |
| 2,765,557 A | | 10/1956 | Roper | |

(Continued)

FOREIGN PATENT DOCUMENTS

WO WO2009113969 9/2009

*Primary Examiner* — Michelle Clement

(74) *Attorney, Agent, or Firm* — The Belles Group, P.C.

(57) ABSTRACT

A shell loading system for a firearm in one embodiment includes a barrel, receiver, reciprocating slide and bolt assembly, tubular magazine, tilting carrier operable to receive and feed shells from the magazine into the action, a spring-biased carrier latch laterally moveable to engage the carrier, and a pawl pivotably mounted on the carrier. A carrier latch disconnect is movable between an unblocking and blocking position that prevents engagement of the carrier latch with carrier. To prevent bouncing of the carrier after firing a shot, a first detent feature on carrier assembly automatically engages a second detent feature in the receiver as the carrier returns downward from an upward position when the action is cycled by discharging the firearm. The detent features automatically disengage when the slide moves rearward to permit normal operation of the carrier when cycling the action.

20 Claims, 21 Drawing Sheets

(56) References Cited

U.S. PATENT DOCUMENTS

| | | | | |
|---|---|---|---|---|
| 2,791,855 | A | 5/1957 | Simmons | |
| 2,827,728 | A * | 3/1958 | Simmons | F41A 9/18 42/17 |
| 3,125,821 | A | 3/1964 | Ruger et al. | |
| 3,142,921 | A | 8/1964 | Ruger | |
| 3,172,222 | A | 3/1965 | Vartanian | |
| 3,371,519 | A | 3/1968 | Dahl et al. | |
| 3,919,800 | A | 11/1975 | Browning | |
| 3,996,685 | A | 12/1976 | Bauman et al. | |
| 4,014,247 | A | 3/1977 | Tollinger | |
| 4,163,334 | A * | 8/1979 | Tollinger | F41A 15/14 42/25 |
| 4,164,088 | A | 8/1979 | Hayashi | |
| 4,856,217 | A | 8/1989 | Benelli | |
| 6,044,580 | A * | 4/2000 | Gussalli Beretta | F41A 9/12 42/17 |
| 6,612,062 | B1 | 9/2003 | Howard et al. | |
| 6,742,298 | B1 | 6/2004 | Howard et al. | |
| 8,312,656 | B2 | 11/2012 | Lesenfants | |
| 8,733,009 | B2 | 5/2014 | Ricks | |
| 9,417,019 | B2 | 8/2016 | Norton | |
| 9,803,940 | B2 * | 10/2017 | Pittman | F41A 9/18 |
| 10,088,257 | B2 * | 10/2018 | Popikov | F41A 3/12 |
| 2010/0275486 | A1 | 11/2010 | Lesenfants | |
| 2011/0308126 | A1 * | 12/2011 | Lesenfants | F41A 9/14 42/17 |
| 2013/0174456 | A1 | 7/2013 | Ricks | |
| 2014/0053716 | A1 | 2/2014 | Norton | |

* cited by examiner

SHELL LOADING SYSTEM FOR FIREARM

CROSS-REFERENCE TO RELATED APPLICATIONS

The present application is a continuation-in-part of U.S. patent application Ser. No. 14/703,164 filed May 4, 2015, which claims the benefit of priority to U.S. Provisional Application No. 61/987,526 filed May 2, 2014; the entireties of which are incorporated herein by reference.

BACKGROUND OF THE INVENTION

The present invention generally relates to firearms, and more particularly to ammunition shell feeding or loading systems suitable for shotguns.

In the design of a semi-automatic firearm such as shotgun, the energy or force needed to fully cycle the action (i.e. open and close the breech) is obtained via expelled gas, inertia, or some other force when the firearm is discharged. This energy or force moves the slide to the rear of receiver. The slide houses and supports the bolt which moves rearward and forward with the slide to form an open action or breech and a closed action or breech in different positions. As the slide travels backwards it must, first unlocking the bolt from the barrel, extract the chambered spent shell, compress the recoil spring, cock the hammer, rotate the carrier pawl, and interact with the carrier latch to correctly time the release of a fresh shell from the magazine tube into the action.

The two conventional ways of timing the release of the shell is to either: (1) allow the carrier latch to contact the slide, in which case this design would increase the friction and force needed to cycle the action; or (2) to release the shell from the magazine tube by pulling the trigger and allow the hammer to interact with the carrier latch, in which case this design would require an additional user operated button to release shells if the action is cycled by hand without pulling the trigger. Both of the foregoing scenarios are undesirable from an operational standpoint.

An improved shell loading system for a firearm is desired.

SUMMARY OF THE INVENTION

A shell loading system is provided which overcomes the foregoing shortcomings. The shell loading system includes a carrier latch disconnect used in the firing and shell loading sequence to time the release of the carrier latch for locking the carrier into the downward loading position for receiving a shell from the magazine, and to block the carrier latch from engaging the carrier when required to upload the shell for chambering. In one non-limiting arrangement, the carrier latch disconnect is operated via the carrier pawl by interaction with the slide. This advantageously results in greater user convenience and smoother operation of the firing and shell loading mechanism.

In one aspect, a shell loading system for a firearm includes: a barrel defining a longitudinal axis and a chamber configured to hold a shell; a receiver coupled to the barrel; an axially reciprocating slide disposed in the receiver and movable between forward and rearward positions; a bolt carrier by the slide and axially aligned with the barrel for forming a closed breech; a magazine configured to retain and feed a plurality of shells into the receiver; a carrier pivotably mounted to the receiver and positioned to receive a shell from the magazine, the carrier movable between a downward loading position and upward feeding position, a pawl pivotably mounted to the carrier, the pawl positioned to alternatingly engage and disengage the slide; a carrier latch pivotably movable from an outward position to an inward position engaging and locking the carrier in the loading position; and a carrier latch disconnect operated by the pawl and pivotably movable into and out of engagement with the carrier latch; wherein rotating the pawl in a first direction disengages the carrier latch disconnect from the carrier latch, and rotating the pawl in a second direction engages the carrier latch disconnect with the carrier latch.

In another aspect, a shell loading system for a firearm includes: a barrel defining a longitudinal axis and a chamber configured to hold a shell; a receiver coupled to the barrel; an axially reciprocating slide and bolt assembly disposed in the receiver and movable between forward and rearward positions; a magazine configured to retain and feed a plurality of shells into the receiver; a carrier movably mounted to the receiver about a first pivot axis, the carrier movable between a downward loading position to receive a shell from the magazine and an upward shell feeding position; a pawl movably mounted to the carrier about a second pivot axis, the slide operable to rotate the pawl between an activated position engaged with the slide and a deactivated position disengaged from the slide; a spring-biased carrier latch pivotably mounted to the receiver and laterally movable to engage the carrier; and a pivotably movable carrier latch disconnect operated by the pawl and interposable between the carrier and carrier latch; wherein rotating the pawl in a first direction inserts a blocking portion of the carrier latch disconnect between the carrier latch and carrier thereby blocking the carrier latch from engaging the carrier, and rotating the pawl in a second direction removes the carrier latch disconnect from between the carrier and carrier latch thereby allowing the carrier latch to engage the carrier.

A method for loading ammunition into a firearm is provided. In one embodiment, the method includes steps of: providing a firearm including a barrel, a receiver, a reciprocating slide aligned with the barrel and movable in forward and rearward axial directions, a bolt carried by the slide and movable therewith into and out of battery with the barrel, a tubular magazine containing a shell, a shell carrier axially aligned with the magazine and pivotably movable between downward and upward positions, and a pivotably mounted carrier latch laterally movable in position to engage or disengage the carrier; placing the carrier in the downward position; positioning a blocking surface of a carrier latch disconnect between the carrier and the carrier latch, the carrier latch disconnect pivotably mounted to the carrier about a first pivot axis; moving the slide in the rearward direction; engaging the slide with a pawl pivotably mounted on the carrier about a second pivot axis to rotate an upper leg of the pawl downwards; rotating a lower leg of the pawl upwards about the second pivot axis; engaging the lower leg of the pawl with an operating arm of the carrier latch disconnect; rotating the operating arm of the carrier latch disconnect upwards about the first pivot axis; rotating the blocking surface of the carrier latch disconnect downwards, wherein the blocking surface is removed from the position between the carrier and carrier latch; and engaging the carrier latch with the carrier to lock the carrier in the downward position.

According to another aspect, a shell loading system including a carrier anti-bounce detent mechanism is provided. The detent mechanism is configured and operable to prevent carrier bounce when the carrier drops back downward from the upward feed position for chambering a new shell. This allows a new shell from the magazine to feed properly into the action, thereby advantageously allowing firing in rapid succession without shell feed jams as further described herein.

In one embodiment, a shell loading system for a firearm includes: a barrel defining a longitudinal axis and a chamber configured to hold a shell; a receiver coupled to the barrel and comprising a firing control housing supporting a trigger-actuated firing mechanism operable to discharge the firearm; an axially reciprocating slide disposed in the receiver and movable between forward and rearward positions; a bolt carried by the slide and axially aligned with the barrel for forming a closed breech; a magazine configured to retain and feed a plurality of shells into the receiver; a carrier assembly comprising: a carrier pivotably mounted in the receiver and positioned to receive a shell from the magazine, the carrier movable between a downward loading position for receiving shells from the magazine and upward feeding position for chambering the shells; a pawl pivotably mounted to the carrier and positioned to engage the slide; a first detent feature disposed on the firing control housing configured to selectively and slideably engage a second detent feature disposed on the carrier assembly; wherein the first and second detent features are fully engaged when the slide is in the forward position and releasably restrain the carrier in the downward loading position. In one embodiment, the first and second detent features are disengaged when the slide is in the rearward position allowing the carrier to move from the downward loading position to the upward feeding position. In one embodiment, the first detent feature may be a protrusion and the second detent feature may be a slot that releasably engages the protrusion.

According to another embodiment, a shell loading system for a firearm includes: a barrel defining a longitudinal axis and rear breech end defining a chamber configured to hold a shell; a receiver coupled to the barrel and supporting a trigger-actuated firing mechanism operable to discharge the firearm; an axially reciprocating slide disposed in the receiver and movable between forward and rearward positions; a magazine configured to retain and feed a plurality of shells into the receiver, a carrier pivotably mounted in the receiver, the carrier movable between a downward loading position for receiving the shells from the magazine and upward feeding position for chambering the shells with the slide; a pawl pivotably mounted to the carrier and positioned to engage the slide; and a carrier anti-bounce detent mechanism comprising a stationary first detent feature disposed on the receiver and a movable second detent feature disposed on the pawl, the first detent feature selectively engageable with the second detent feature; wherein rotating the pawl in a first direction disengages the first and second detent features, and rotating the pawl in a second direction mutually engages the first and second detent features.

According to another embodiment, a method for operating a shotgun having carrier detent mechanism includes: providing a shotgun including a barrel, a receiver, a reciprocating slide aligned with the barrel and axially movable into and out of battery with the barrel respectively, a tubular magazine containing a shell, a shell carrier assembly axially aligned with the magazine and pivotably movable between downward and upward positions, and a carrier detent mechanism movable to selectively engage or disengage the carrier assembly; firstly moving the slide to a forward closed breech position in battery with the barrel; mutually engaging a first detent feature on the receiver with a second detent feature on the carrier assembly, the engaged first and second detent features releasably holding the carrier assembly in the downward position; and secondly moving the slide to a rearward open breech position, the slide acting on the carrier assembly to disengage the second detent feature from the first detent feature on the receiver, the disengaged first and second detent features allowing the carrier to move from the downward position to the upward position.

Further areas of applicability of the present invention will become apparent from the detailed description hereafter and drawings.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a whole figure number (e.g. FIG. 1) shall be construed to be a reference to all subpart figures in the group (e.g. FIGS. 1A, 1B, etc.) unless otherwise indicated.

DETAILED DESCRIPTION OF THE INVENTION

Figure 1:
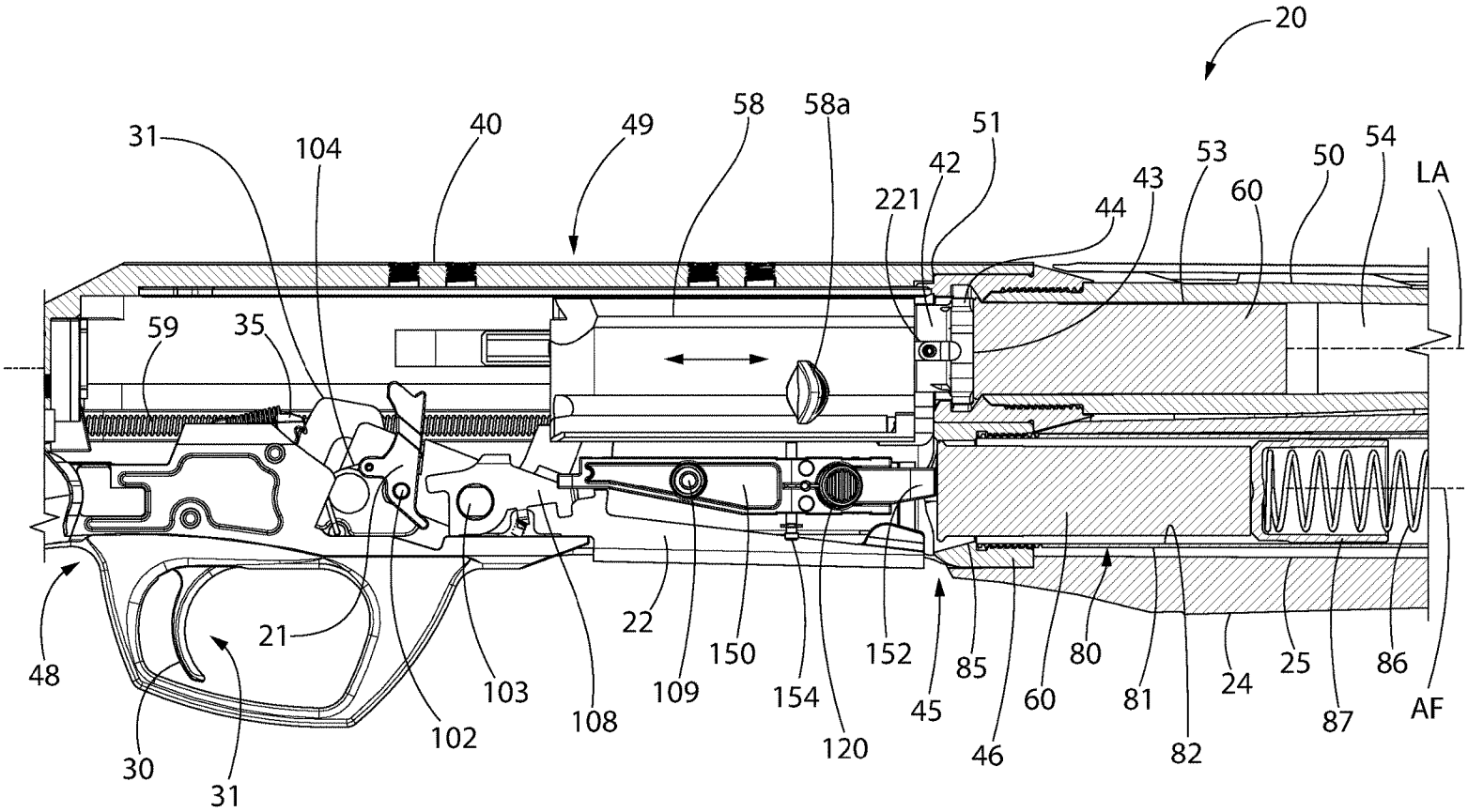
FIG. 1 is a right partial cross sectional elevation view of one exemplary embodiment of a receiver portion of a firearm including a shell loading system according to the present disclosure, the firearm shown in a ready-to-fire position with a closed breech.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art to connote the mechanism that loads and ejects shells into/from the firearm and opens and closes the breech (i.e. the area in the receiver between an openable/closeable breech face on the front of the bolt and the rear face of barrel chamber).

FIGS. 1, 2, 4, 6, 8, and 9 are longitudinal cross section elevation views of the receiver portion of a shotgun 20 showing sequential positions of the action as it is cycled using a shell loading system according to an exemplary embodiment of the present disclosure. The shotgun may be configured as an auto-loading inertia driven or expelled exhaust gas operated loading mechanism in some embodiments as disclosed herein. Although the present disclosure and drawings depict a shotgun, it will be appreciated that the invention is not limited in its applicability to shotguns alone. Accordingly, the firearm may be a rifle using a carrier or lift to load ammunition cartridges into the action which may equally benefit from the present invention.

Shotgun 20 generally includes a receiver 40, a barrel 50 supported by the receiver, a forearm 24 for grasping the shotgun, and a trigger-actuated firing mechanism 19 including a trigger 30 movably supported by the receiver. The forearm 24 may be supported by the barrel 50 and/or front end of the receiver 40. The forearm 24 may be made of natural materials (e.g. wood) and/or synthetic materials (e.g. plastic, fiberglass, carbon-graphite composites, etc.), and is not limiting of the invention.

The receiver 40 includes a lower receiver 48 that supports the firing mechanism 19 and an upper receiver 49 axially aligned with and coupled to the barrel 50. Lower receiver 48 may be considered and configured as a firing control housing 148 as shown which supports the trigger-operated firing mechanism components and portions of the shell loading system as described herein. The receiver 40 forms an internally open receptacle that houses the firing mechanism components, which may include an axially slidable slide 58, rotatable locking bolt 42 which is carried by the slide and movable therewith to form a locked or unlocked breech, a spring-biased striker or firing pin 41 carried by the bolt and slide for detonating a chambered shell 60, a spring-biased pivotable hammer 31 operable to strike an exposed rear end of the firing pin 41 protruding from the slide for detonating the shell (see, e.g. FIGS. 8 and 9), a forwardly spring-biased sear 35 operable to hold and release the hammer from a cocked position for discharging the shotgun via a trigger pull, and other parts and linkages to form a fully functional firing and shell loading system.

Sear 35, biased by sear spring 35*b*, is positioned behind the hammer 31 and includes a downwardly extending hook 35*a* arranged to engage a sear notch 31*a* formed on the hammer for holding the hammer in the rearward cocked position. Spring 35*b* acts to create a positive engagement between the hook 35*a* and sear notch 31*a* in the absence of a trigger pull to avoid inadvertent firing. Slide 58 and bolt 42 are biased in a forward direction toward a closed breech position (i.e. bolt head in battery with barrel) by one or more recoil springs 59. The slide 58 may include a laterally protruding operating handle 58*a* to manually cycle the action.

The barrel 50 has an open rear breech end 51 defining a chamber 53 configured for holding a shell and an opposite open front muzzle end. The area rear of the shell chamber 53 defines an openable/closeable breech in conjunction with the axially movable bolt 42. The barrel 50 has an axially extending bore 54 forming a projectile pathway between the barrel ends which is coaxially aligned with and defines the longitudinal axis LA and corresponding axial direction. The barrel 50 may be coupled to the front end 45 of the receiver 40 at the upper receiver 49 in axial alignment with the bolt 42 and firing pin 41. In one embodiment, barrel 50 may be threadably attached to the receiver 40; however, other modes of attachment may be used.

The bolt 42 has an exposed head 44 protruding forward from the slide 58 that includes radially protruding lugs configured to engage mating lugs at the rear end 51 of the barrel 50 for forming a locked or unlocked breech, as is well known in the art without further elaboration. The front end of the bolt head 44 defines a vertical breech face 43 that engages and supports the rear head 62 and integral rim or flange 64 of the chambered shell 60 when the breech is closed for firing (see, e.g. FIGS. 1 and 7A-B indicating shell parts). The front end of firing pin 41 extends from inside the slide 58 through the breech face 43 of the bolt head 44 for contacting and detonating when the rear end of the firing pin is struck by the hammer 31.

The shell loading system of shotgun 20 will now be further described. Referring to FIGS. 1, 2, 4, 6, 8, and 9, shotgun 20 further includes a tubular magazine 80 configured for holding a plurality of shotgun shells 60. Magazine 80 defines a shell feeding axis Af, which in the illustrated embodiments is substantially parallel to longitudinal axis LA. Shells 60 include a metallic head 62 (typically formed from brass), a diametrically enlarged rear rim or flange 64 formed thereon, and case or hull 61 that contains the shot/projectile and wadding (see, e.g. FIGS. 7A-B).

The magazine 80 includes an elongated tubular body (also referred to as "magazine tube") which may formed of a metal tube having cylindrical walls 81 that form an axially extending internal cavity 82 configured and dimensioned to hold the shells 60 in horizontally stacked end-to-end relationship. In other possible embodiments, a non-metal tube may be used (e.g. plastic or other). Magazine 80 includes a closed front end and an open rear end 85 for loading and dispensing shells 60. A magazine spring 86 and follower 87 assembly is disposed inside the magazine tube. The spring 86 has a front end abutting the closed front end of the magazine and rear end engaging the follower 87. The spring 86 biases the follower 87 rearward for feeding the stack of shells 60 into the receiver 40 (e.g. lower receiver 48).

The magazine 80 may be attached to and supported by the barrel 50 and lower receiver 48 in any suitable manner. In one embodiment, the rear end 85 of the magazine 80 may be threadably or slideably inserted into a forwardly open socket 46 formed on the front end 45 of the lower receiver 48 for coupling magazine tube to the receiver. In the illustrated embodiment, the rear end 85 of the magazine 80 has external threads 75 to rotatably engage an internally threaded socket 46 in lieu of a sliding slip fit. Other mounting arrangements and configurations are possible.

The forearm 24 of the shotgun 20 has an a longitudinally extending open channel 25 which receives and at least partially encloses the magazine 80. Accordingly, the magazine 80 may be substantially concealed and disposed inside the forearm. The channel 25 may be open at the top for mounting over the magazine 70 giving the forearm 24 a generally U-shaped transverse cross-sectional shape. The magazine 80 is disposed below the barrel and arranged substantially parallel to the longitudinal axis LA.

Referring to FIGS. 1-11, the shotgun 20 further includes a carrier 22 for uploading shells 60 to be chambered into the action. Carrier 22 rotates about its pivot axis 103 formed by transverse mounting pin 103*a* coupled to the receiver 40 (e.g. lower receiver 48 also considered a firing control housing). A carrier pawl 21 in turn is pivotably connected to the carrier 22 and operable to rotate about its pivot axis 102 formed by a second transverse mounting pin 102*a*. Pivot axes 102 and 103 may be parallel in relationship with pivot axis 102 being located rearward of axis 103. The carrier pawl 21 interfaces with and operates the carrier 22 and a carrier latch disconnect 200, as further described herein. Carrier 22 is axially aligned with the shell feed axis Af defined by the tubular magazine 80 for dispensing shells 60 onto the carrier, as further described herein.

A spring 104 is connected to the rear of carrier pawl 21. In one non-limiting embodiment, spring 104 may be a torsion spring as shown having one leg attached to the receiver 40 and the other leg attached to the pawl above and rearward of pivot axis 102. A rearwardly extending spring mounting protrusion 104*a* may be provided for attachment of the spring to the pawl as shown. It will be appreciated that other types of springs may be used, such as helical compression springs or others. The direction of the spring force 105 rotates (clockwise) and biases the rear mounting portion 22*b* of the carrier 22 upwards and concomitantly the front loading portion 22*a* of the carrier 22 downwards, and also rotates the carrier pawl (clockwise) about axis 102 to a vertical or upright deactivated position shown in FIGS. 1 and 2. Accordingly, spring 104 acts to bias both the pawl 21 and carrier 22 to which the pawl is connected.

Figure 2:
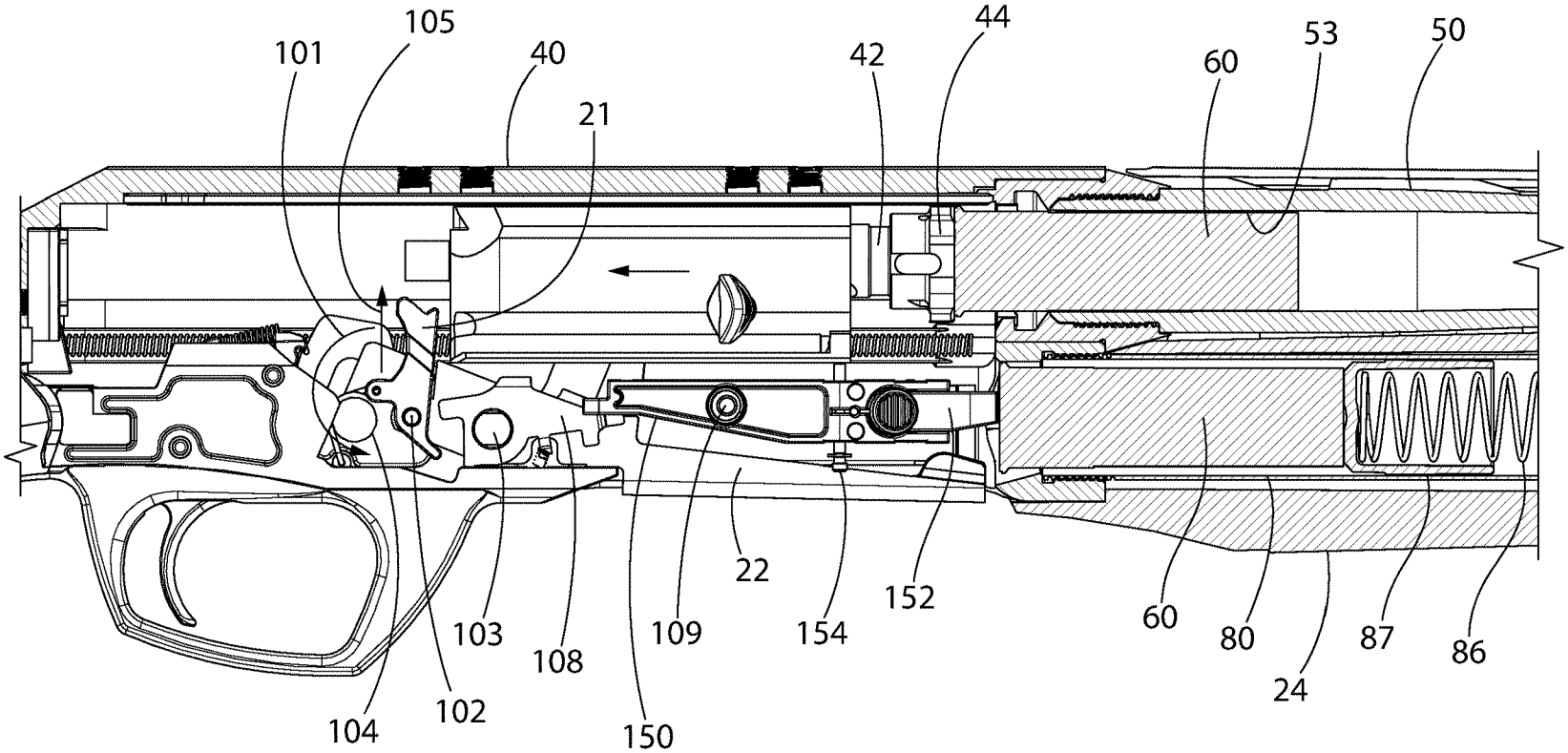
FIG. 2 is a right cross-sectional view thereof showing a shell partially extracted from the chamber and slide/bolt assembly moving rearwards with a partially open breech.
Figure 4:
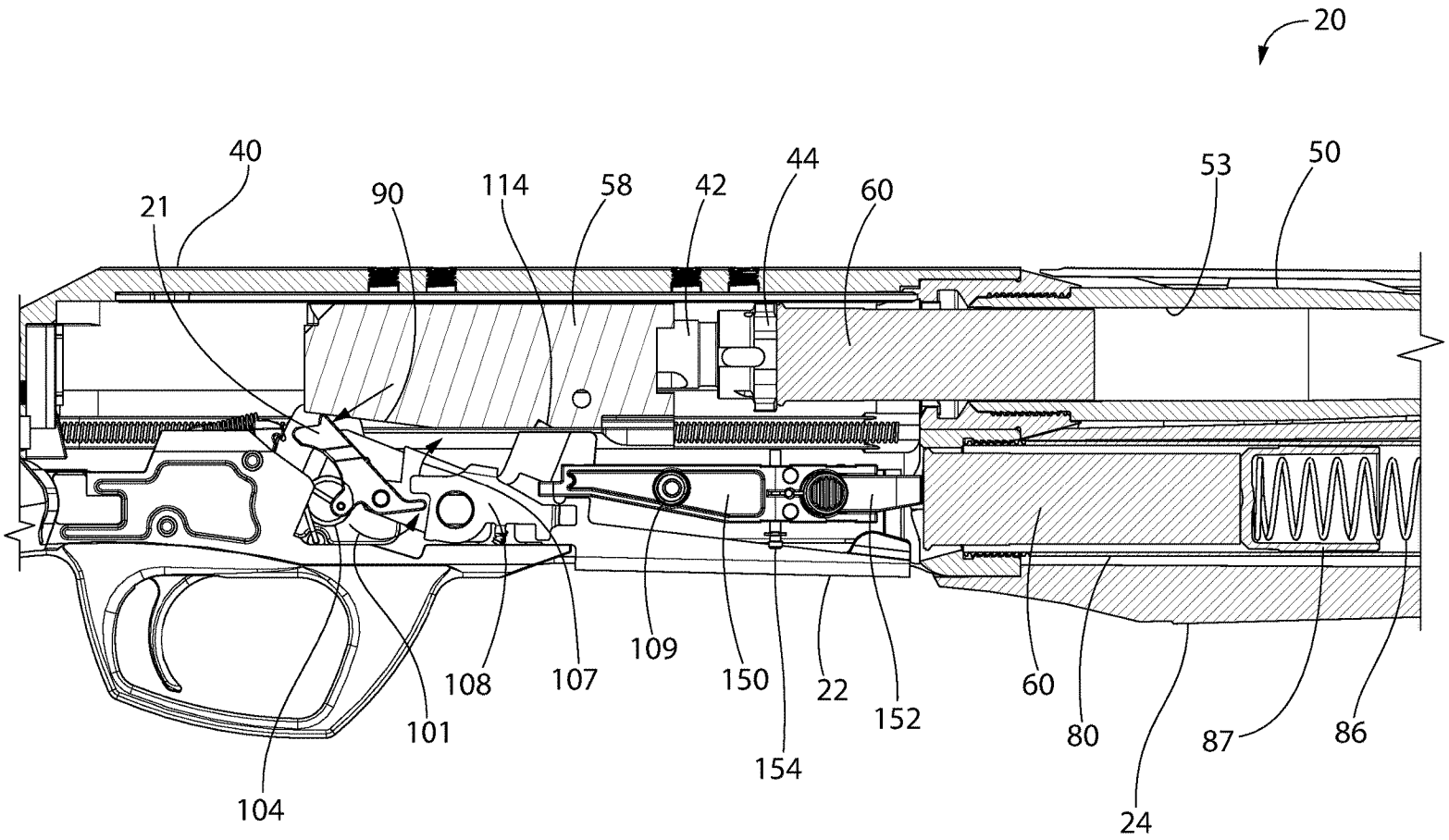
FIG. 4 is a right partial cross sectional elevation view of the firearm of FIG. 1 showing the shell partially extracted from the chamber and slide/bolt assembly moving farther rearwards with a partially open breech.

As the slide 58 moves toward the rear of the receiver when the action is cycled, either manually by hand or automatically under recoil by firing the chambered shell, a bottom surface 90 of the slide contacts the carrier pawl 21 causing it to rotate downwards in a counter-clockwise direction 101 about its pivot axis 102 to an activated position, as sequentially shown in FIGS. 2 and 4. In one embodiment, the bottom surface 90 of slide 58 may be obliquely angled with respect to the longitudinal axis LA (see, e.g. FIG. 4) for smooth non-binding engagement with the carrier pawl.

Figure 3:
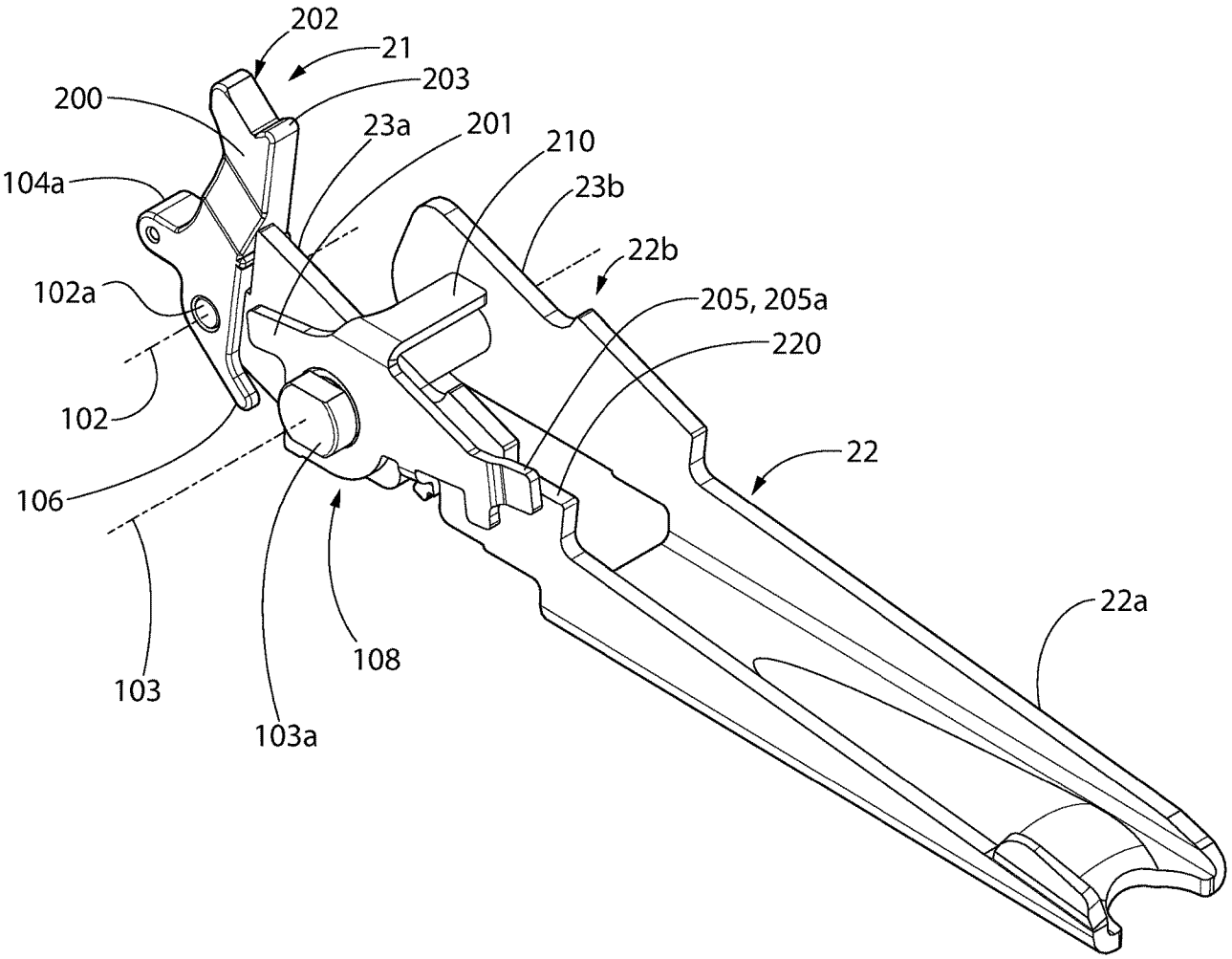
FIG. 3 is a perspective view of the carrier assembly of FIG. 1 including the carrier, pawl, and carrier latch disconnect.

FIG. 3 is a perspective view showing the carrier pawl 21 and a carrier latch disconnect 200 both pivotably connected to the carrier 22. In one embodiment, the carrier latch disconnect 200 may be pivotably mounted to the carrier 22 about the carrier pivot axis 103 and mounting pin 103*a* to conserve parts and space. In other embodiments, the carrier latch disconnect may be mounted on a separate pivot axis and pin. Both the carrier pawl 21 and carrier latch disconnect 200 are pivotably movable independently of each other and the carrier 22. Accordingly, both the carrier pawl and carrier latch disconnect may move while the carrier remains stationary.

Figure 7A:
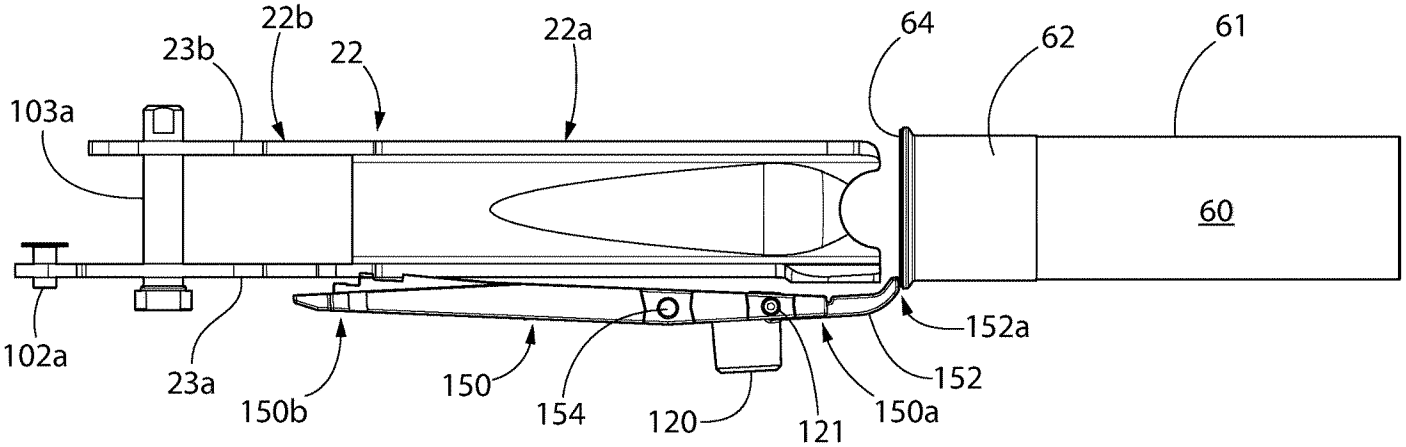
FIG. 7A is a top plan view of the carrier and carrier latch in a first operating position engaging a shell; is a left side elevation view of the firearm showing an accessible shell release lever.
Figure 7B:
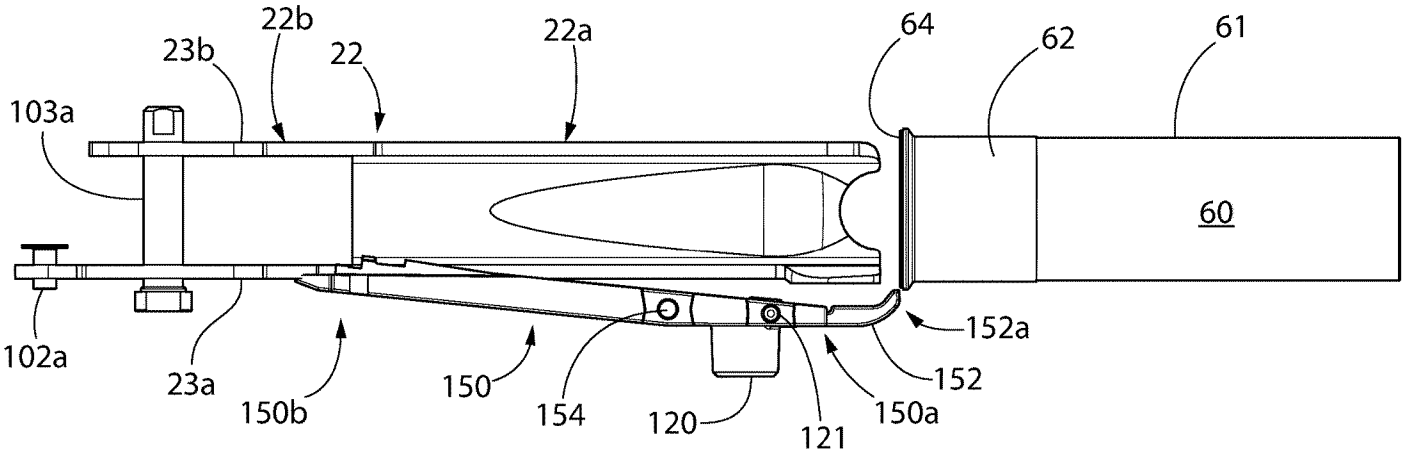
FIG. 7B is a top plan view of the carrier and carrier latch in a second operating position disengaging and releasing the shell.

In one configuration, the carrier 22 includes a front end defining a front loading portion 22*a* configured as an open tray-like structure configured to hold a shell and a rear end defining a rear mounting portion 22*b* for coupling the carrier to the receiver 40. The rear mounting portion 22*b* may have a bifurcated structure in one embodiment comprised of horizontally/laterally spaced apart right and left ear plates 23*a* and 23*b* as best shown in FIGS. 3 and 7A-B. The ear plates 23*a*, 23*b* may have a substantially flat configuration and vertical orientation as shown. The carrier pawl 21 and carrier latch disconnect 200 may be connected to one of the ear plates 23*a* as shown preferably on the same side of the receiver 40 as the carrier latch 150. The carrier mounting pin 103*a* extends through both ear plates 23*a*, 23*b* in one embodiment.

Carrier 22 is pivotably and vertically movable from a downward loading position for receiving shells 60 from magazine 80 (see, e.g. FIG. 6) to an upward feeding position (see, e.g. FIG. 8) for feeding shells into the breech area of the upper receiver 49 where the shells become positioned to be engaged and chambered by the sliding slide-bolt assembly as the breech and action closes.

Referring to FIGS. 3, 5A-B, 6, 10, and 11, carrier pawl 21 has an elongated body comprising a lower leg 106 positioned below pivot axis 102 (i.e. pin 102*a*) and an upper leg 200 positioned above pivot axis 102 when the pawl is in an upright vertical position. The lower leg 106 is rotatable upwards (counter-clockwise) about pivot axis 102 and positioned to engage a rearwardly extending actuating arm 201 of the carrier latch disconnect 108. The upper leg 200 includes a terminal end 202 which is configured and positioned to engage the bottom surface 90 of slide 58 (see also FIGS. 4, 6, and 8). Terminal end 202 may include a V-shaped extension 203 which is arranged to engage a pawl notch 114 disposed on the bottom surface 90 of slide 58 for holding the slide in a rearward position associated with a fully open breech for uploading shells into the upper receiver 49 (see, e.g. FIGS. 6 and 8). In one embodiment, a rearwardly extending protrusion 201 may be provided for fastening one leg of spring 104 to the pawl 21. The other end of spring 104 may be fastened to the lower receiver 48. Spring 104 biases the carrier pawl 21 forward into a vertical upright position substantially perpendicular to the longitudinal axis LA, as shown in FIG. 1. The pawl 21 is pivotably movable rearwards (counter-clockwise) from the upright position to a downward position oriented at an oblique angle to the longitudinal axis LA (see, e.g. FIG. 6).

Referring to FIGS. 3, 5A-B, 6, 10, and 11, the carrier latch disconnect 108 has an elongated body comprising rearwardly extending actuating arm 201 positioned rearward of pivot axis 103 (i.e. pin 103*a*) and front blocking portion 204 extending forward from pivot axis 103. Blocking portion 204 defines an outward facing front blocking surface 205*a* positionable by rotating the carrier latch disconnect 108 to engage a corresponding inward facing blocking surface 111*a* formed by an inward projecting carrier lock protrusion 111 on the rear of the carrier latch 150. Accordingly, the blocking surface 205*a* is vertically oriented and interposable between the carrier 22 and carrier latch 150 for preventing engagement between the carrier lock protrusion 111 and carrier. In one embodiment, blocking surface 205*a* of the carrier latch disconnect 108 may be formed on a forwardly extending protrusion 205 of the blocking portion 204. The carrier latch disconnect 108 is pivotably movable from an upper raised blocking position (FIG. 5A) laterally engaged with the carrier lock protrusion 111 on the rear end 150*b* of the carrier latch 150 to a downward lowered non-blocking position (FIG. 5B) disengaged from carrier lock protrusion 111. When the carrier latch disconnect 108 is in a raised blocking position, the carrier latch 150 is blocked by the disconnect from rotating inwards to engage and hold down the carrier as further described herein. The carrier latch disconnect is biased upwards towards the blocking position by spring 115. Spring 115 may be a helical compression spring in one embodiment; however, other types of springs may be used. The top end of the spring 115 may engage a downwardly projecting spring mounting tab 206 on the disconnect 108 to hold the spring in place (see, e.g. FIGS. 10 and 11).

According to one aspect of the invention, it is advantageous to lock the carrier 22 down during firing to prevent the recoil of the firearm from affecting the position of the carrier during dispensing and loading of a shell 60 rearward from the magazine 80 onto the carrier. In one embodiment, this is accomplished by adding a hammer interface to the carrier latch disconnect 108. The hammer interface comprises a laterally and inwardly extending cantilevered hammer stop arm 210 as best shown in FIGS. 5A, 5B, 10, and 11. Stop arm 210 may be disposed transversely to the longitudinal axis LA at a 90 degree angle (perpendicular) to the main body of the disconnect which is aligned parallel to the longitudinal axis. The stop arm 210 is arranged to engage the hammer 31 when released from the rearward cocked position. Upon firing as the hammer 31 rotates clockwise toward the firing pin, the hammer (spring biased in a forward clockwise direction) contacts the hammer stop arm 210 of the carrier latch disconnect 108. This rotates and forces the front blocking surface 205*a* of the disconnect 108 downwards, thus disengaging the carrier latch 150 and allowing the rear carrier lock protrusion 111 on the rear end 150*b* of the latch to pivot inwards and engage the carrier 22 which is then locked in the downward loading position (see, e.g. FIGS. 5B and 6). In the loading position, the carrier lock protrusion 111 on carrier latch 150 engages an upward facing horizontal surface 220 of the carrier 22 to retain and lock the carrier in the downward loading position.

Referring now generally to FIGS. 1-11, the carrier latch 150 cooperates with the carrier 22 to time and control the release of shells 60 from the magazine 80 so that only a single shell is loaded onto the carrier and raised into the breech area at a time to prevent jams. Carrier latch 150 is pivotably mounted to the right side of the receiver 40 (e.g. lower receiver 48) as illustrated via a transversely mounted vertical pin 154 that defines a pivot axis 110. The carrier latch 150 has an elongated body extending between a front end 150*a* and rear end 150*b*. A shell stop 152 is disposed on the front end 50*a* of the carrier latch 150 for retaining the shells in magazine 80 until dispensed. In one embodiment, the shell stop 152 may be pivotably mounted to a front portion of the carrier latch 150 about a vertically oriented pivot axis which may be formed by a pinned connection comprising transversely mounted vertical pin that defines a pivot axis 121. The shell stop 152 includes an integral carrier latch operating button 120 (see, e.g. FIGS. 7A-B) which functions to both pivotably move the carrier latch 150 with respect to the receiver 40 and further to pivotably move the shell stop 152 with respect to the carrier latch to manually unload shells 60 from the magazine 80. The pivot axes of the carrier latch 150 and shell stop 152 may each be vertical and parallel to one other in one embodiment.

The shell stop 152 has an elongated body and includes an inwardly hooked front end 152*a* positioned to engage the rear flange 64 of the rearmost shell 60 in the magazine 80 to retain the shell and control the further feed of shells into the breech in a conventional regulated fashion (see, e.g. FIG. 7A). When the action is cycled such as by firing the shotgun 20, the carrier latch 150 is pivoted by the action to move the shell stop 152 laterally outwards away from the rear end 85 of magazine 80. This disengages the shell stop 152 from the rearmost shell 60 which is then released to the carrier 22 by the spring-biased follower 87 for loading another round into the barrel chamber 53 (see, e.g. FIG. 7B). This process is repeated each time the shotgun is fired.

A method and process for operating the exemplary shell loading system will now be described. The process of loading a shell starts with FIG. 1 showing shotgun 20 in the ready-to-fire condition. A shell 60 is chambered and the breech is closed with the bolt head 51 engaging and in battery with the head 62 of the shell. The rear end 150*b* of carrier latch 150 is pivoted outwards and front end 150*a* concomitantly pivoted inwards about the pivot axis 110 formed by pin 154 so that shell stop 152 engages the rim 64 of the shell to retain it in the tubular magazine 80 (see also FIG. 7A). The carrier latch disconnect 108 is in the raised blocking position preventing the carrier latch 150 from pivoting inwards to engage the carrier. Carrier 22 is held in the downward loading position by the upward biasing force 105 caused by spring 104 acting on the rear mounting portion 22*b* of the carrier through the carrier pawl 21 (see also FIG. 2).

FIG. 2 shows the shotgun 20 immediately after firing. The slide 58 and bolt 42 begin to move rewards under recoil as the spent (discharged) shell 60 is withdrawn from chamber 53 by the extractor 221 mounted on the bolt head 44.

As the slide 58 continues to move toward the rear of the receiver 40, the bottom surface 90 of the slide eventually contacts the terminal end 202 on upper leg 200 of the carrier pawl 21 as shown FIG. 4 causing the pawl to rotate downwards in a counter-clockwise direction 101 about its pivot axis 102 (see directional arrow). In operation when the carrier pawl 21 is engaged by and rotates to pass underneath the slide 58 moving rearward, the lower leg 106 of the carrier pawl concomitantly rotates counter-clockwise and upward thereby contacting the underside of the rearward extending actuating arm 201 of the carrier latch disconnect 108. This rotates the carrier latch disconnect 108 in a clockwise direction 107 about the carrier pivot axis 103 to lower the front blocking surface 205*a* of the disconnect which heretofore is laterally engaged with the inward projecting carrier lock protrusion 111 on the rear of the carrier latch 150 (see also FIGS. 5A-B and directional arrows). Once the front blocking surface 205*a* of the carrier latch disconnect 108 is no longer interspersed between the carrier and carrier latch and disengages protrusion 111 on the carrier latch 150, the laterally acting carrier latch spring 109 now freely rotates the rear end 150*b* and protrusion 111 thereon of the carrier latch about its vertically oriented pivot axis 110 and over top of the carrier latch disconnect blocking surface 205*a*, thus locking the carrier 22 in the downward loading position by engaging the rear of the carrier latch with the carrier and simultaneously rotating the shell stop 152 on the front of the carrier latch outward with the carrier latch to allow shells 60 to exit the magazine 80 tube.

Figure 5A:
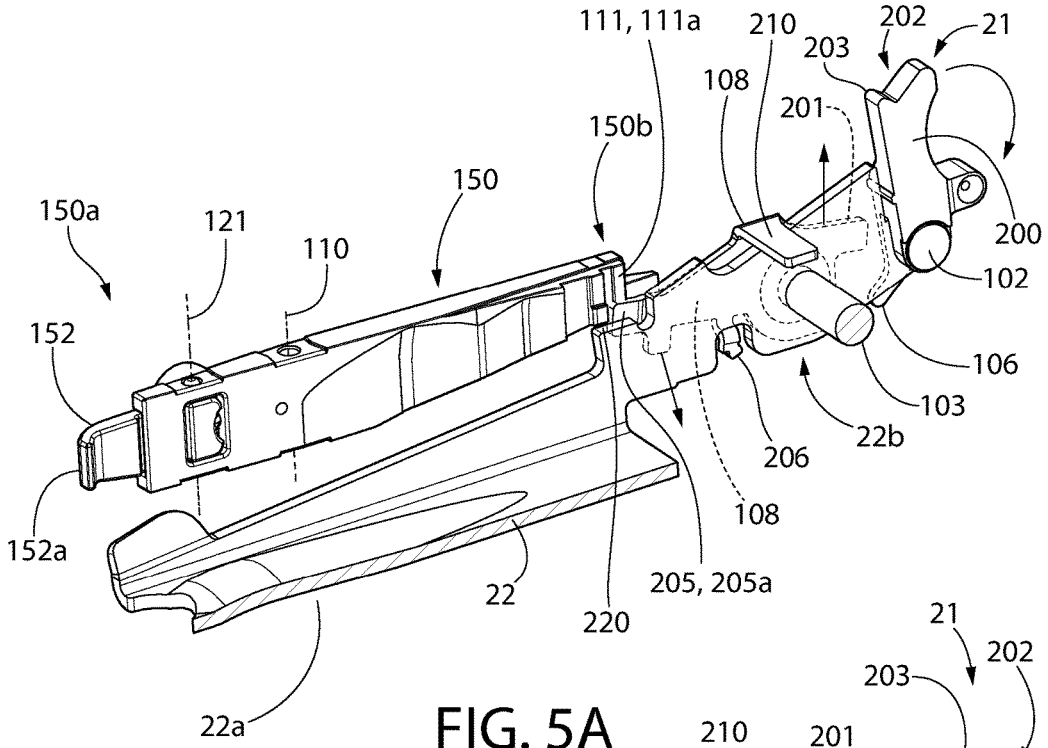
FIG. 5A is a perspective view of the carrier assembly and carrier latch of FIG. 1 in a first operating position.

FIG. 5A shows the carrier latch 150 laterally contacting the carrier latch disconnect. The carrier latch disconnect 108 is in a raised blocking position in which the rear end 150*b* of the carrier latch 150 is blocked by the disconnect from rotating inwards to engage the carrier 22 (see directional arrows).

Figure 5B:
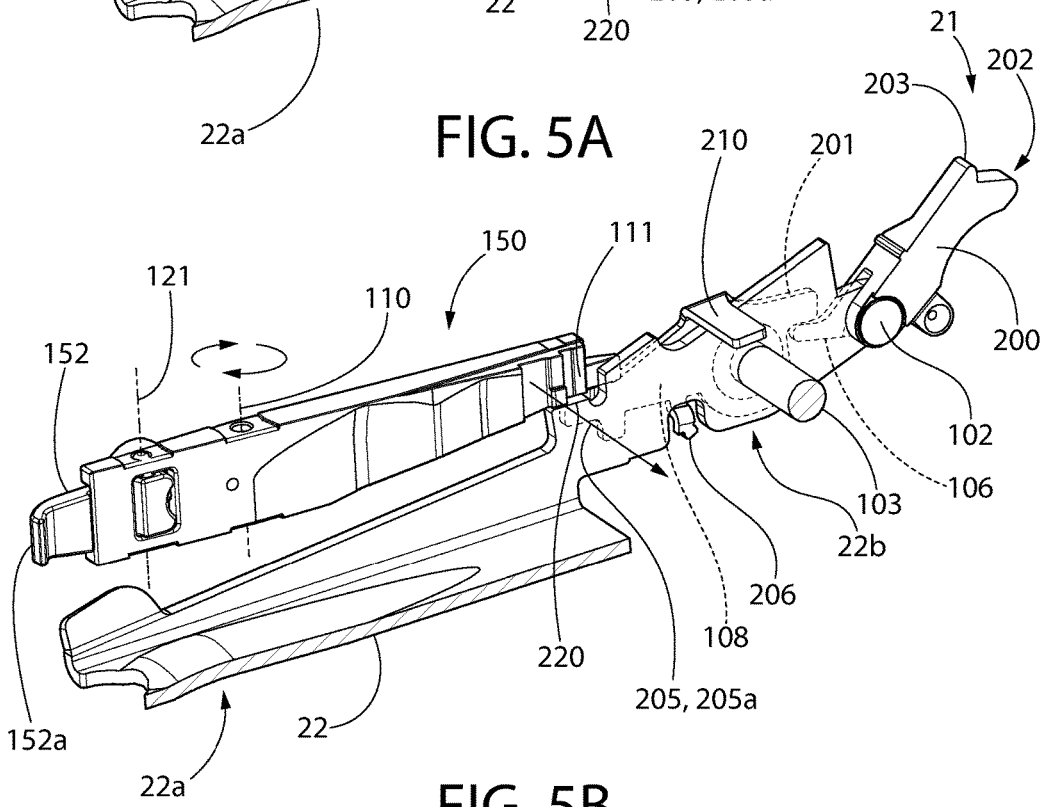
FIG. 5B is a perspective view of the carrier assembly and carrier latch of FIG. 1 in a second operating position.

FIG. 5B shows the rotating carrier pawl 21 simultaneously rotating the carrier latch disconnect 108 to disengage the carrier latch 150 and the rear carrier latch protrusion 111 thereon from blocking surface 205*a* of the disconnect. The now unblocked latch protrusion 111 is in the process of rotating inwards about its pivot axis 110 to engage horizontal surface 220 on the carrier 22. The carrier 22 is locked in the downward loading position by the carrier latch 150. The carrier latch disconnect 108 is in the lowered non-blocking position.

Figure 6:
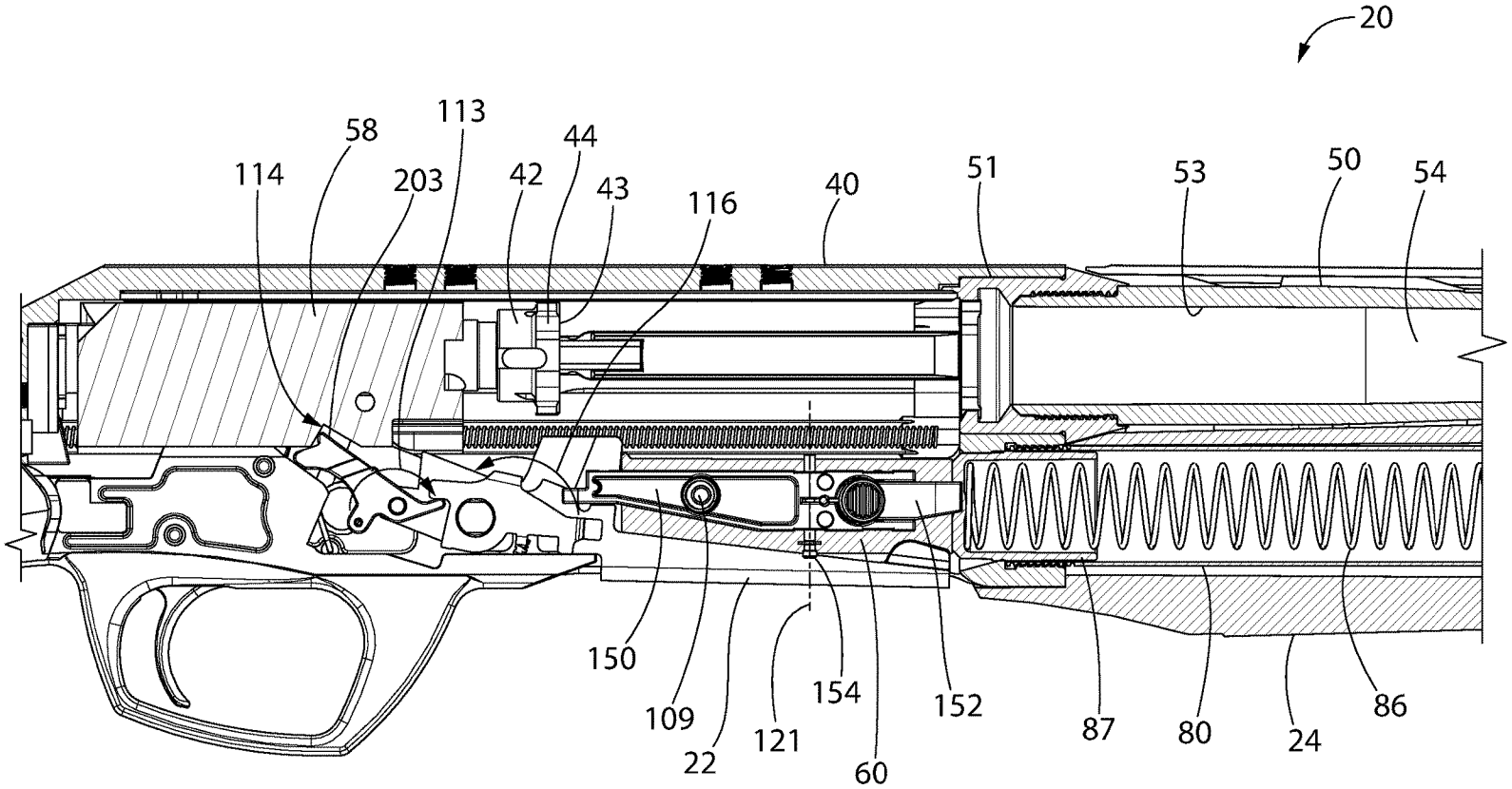
FIG. 6 is a right partial cross sectional elevation view of the firearm of FIG. 1 showing the shell ejected from the firearm and slide/bolt assembly moving farther rearwards with a fully open breech.

As the slide 58 continues rearward now referring to FIG. 6, the extracted shell 60 is ejected from the shotgun and the fresh shell in the magazine 80 tube is forced onto the carrier 22 by the magazine tube spring 86. As the shell moves out of the magazine 80 tube and toward the rear of the receiver 40, the rim 64 of the shell engages the rear end 150*b* of the carrier latch 150 causing the carrier latch to rotate laterally about its pivot axis 110 outward and compress the carrier latch spring 109 which normally biases the rear end 150*b* of the carrier latch inward towards the longitudinal axis LA. This unlocks the carrier 22. As the carrier latch rotates, the shell stop 152 is positioned to block any remaining retained shells from exiting the magazine 80 tube to prevent the feeding of multiple shells at one time and avoid jams.

Once the slide 58 reaches the end of its travel, the compressed recoil spring 59 pushes and returns the slide forward until the carrier pawl 21 rotates in a clockwise direction 113 (see FIG. 6) to engage the pawl notch 114 in the underside of the slide. With the rim 64 of the shell 60 positioning the rear end 150*b* of the carrier latch outwards away from the carrier latch disconnect 108, the force from the carrier latch disconnect spring 115 can rotate the carrier latch disconnect in counter-clockwise direction 116 back into the upward blocking position, thereby blocking the carrier latch 150 from engaging the carrier 22 once the rim 64 of the shell no longer engages the carrier latch.

FIG. 7A shows the shell stop 152 positioned to retain shells 60 in the magazine 80 tube in a laterally inward position. FIG. 7B shows the shell stop 152 positioned to release shells from the magazine tube in a laterally displaced outward position.

Figure 8:
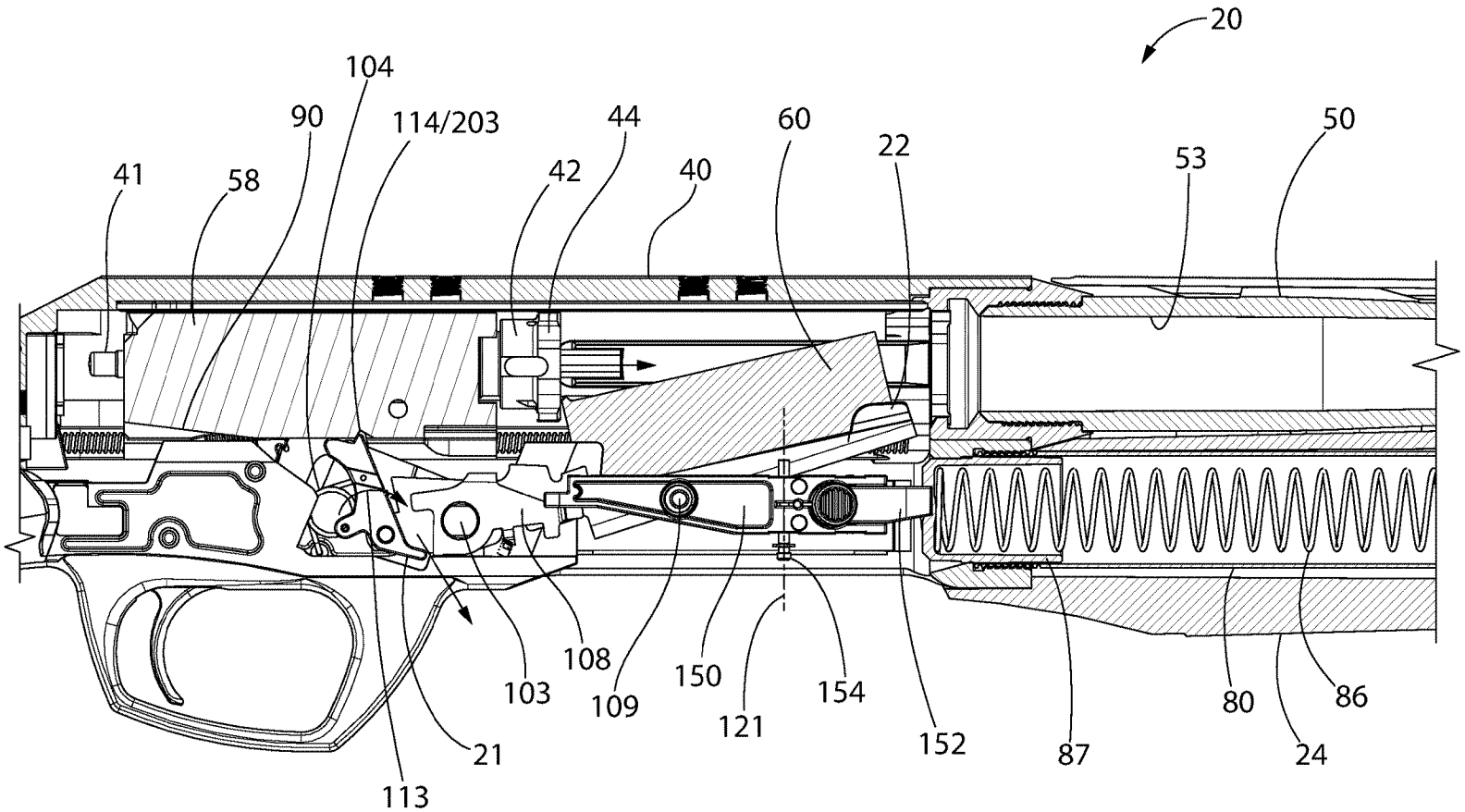
FIG. 8 is a right partial cross sectional elevation view of the firearm of FIG. 1 showing the shell being lifted by the carrier upwards for loading into the barrel with a fully open breech, the carrier is in an upper tilted feeding position.

As the slide now continues forward as shown in FIG. 8, engagement between the slide 58 and carrier pawl 21 rotates the carrier pawl farther in the clockwise direction 113 and drives the back of the carrier 22 down (directional arrow 117) because the pawl is mounted on the rear mounting portion 22*b* of the carrier, thereby correspondingly raising the front loading portion 22*a* of the carrier. This lifts the shell 60 and positions it for loading into the chamber 53 by engaging the forward moving bolt 42 and slide 58. Once the rim 64 of the shell 60 no longer engages the carrier latch 150, the carrier latch spring 109 rotates the carrier latch about its pivot axis 110 until it engages the carrier latch disconnect 108 which prevents the carrier latch from locking the carrier down.

Figure 9:
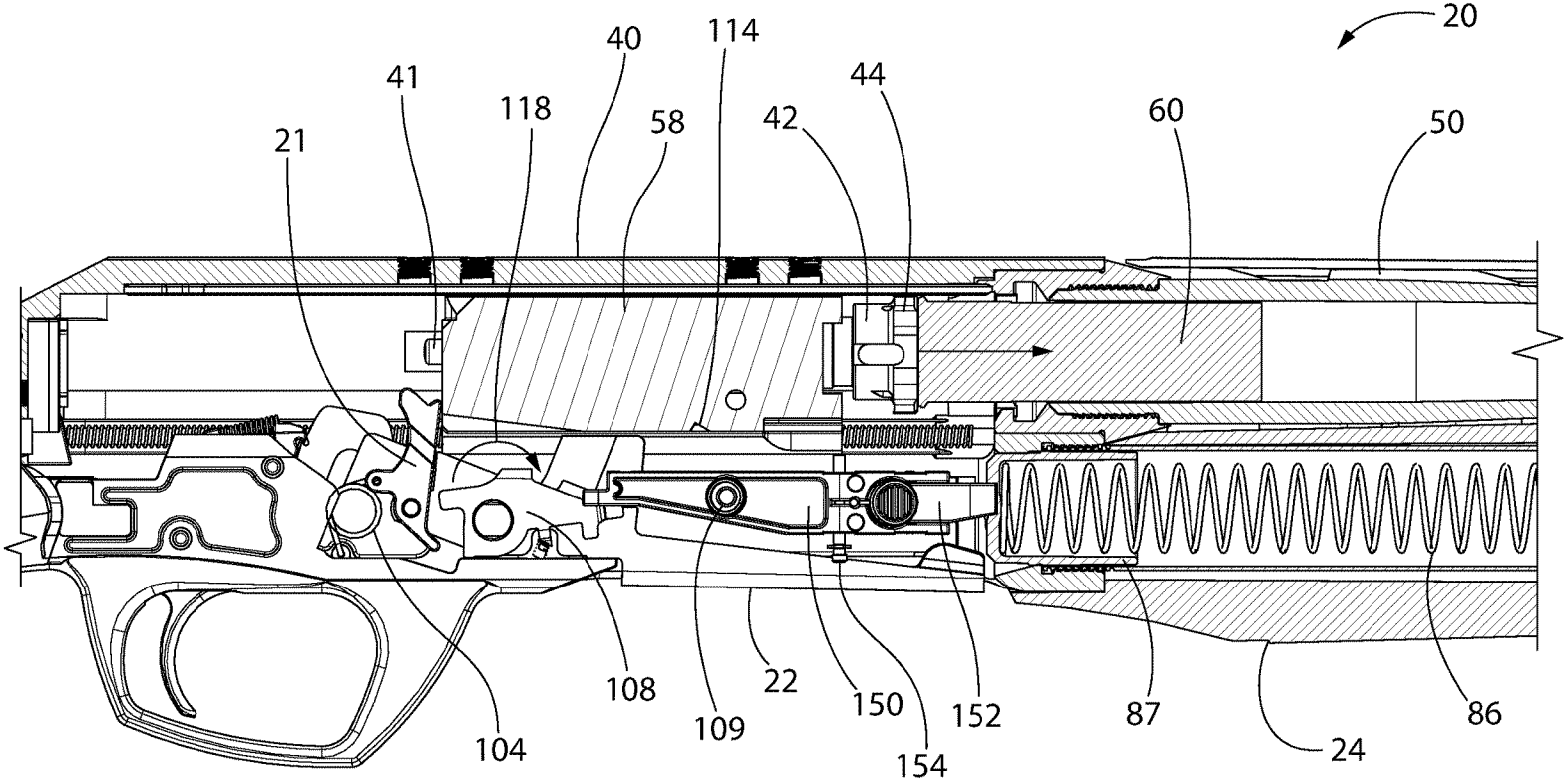
FIG. 9 is a right partial cross sectional elevation view thereof showing the shell being loaded into the barrel with a partially closed breech and the carrier returned to a downward horizontal loading position.
Figure 10:
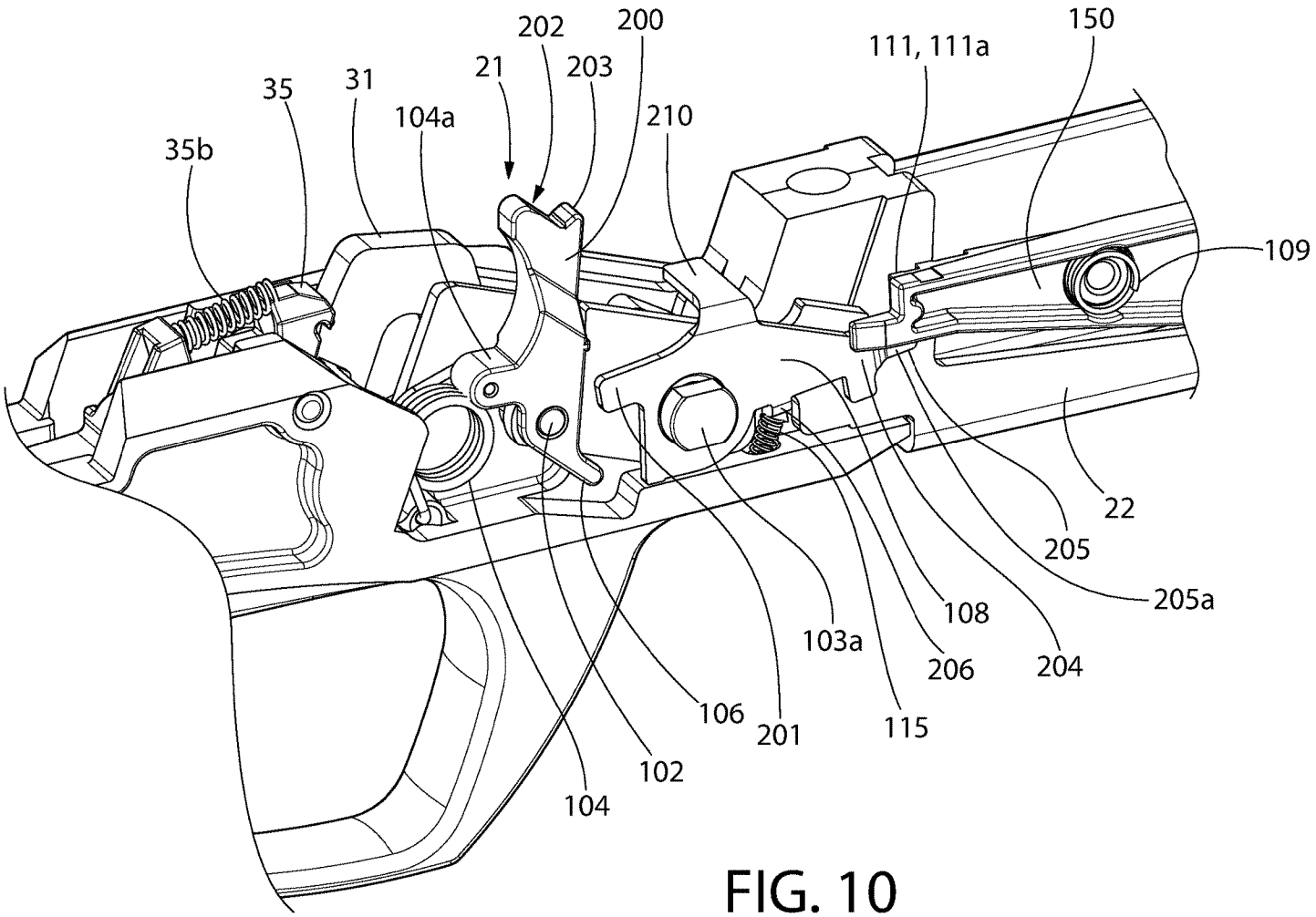
FIG. 10 is a perspective view of the shell loading system components in a first operating position with a cocked hammer.
Figure 11:
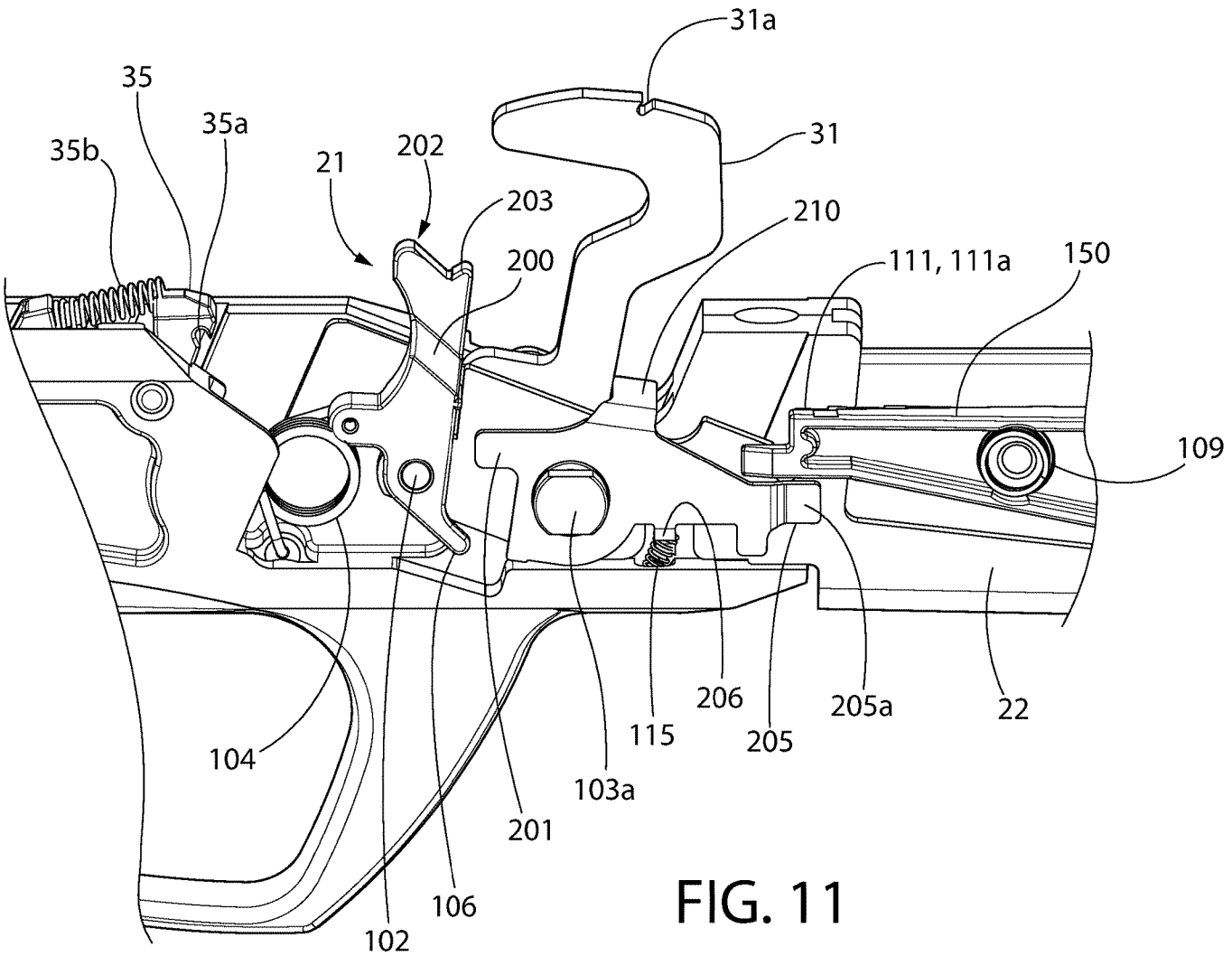
FIG. 11 is a perspective view thereof in a second operating position with a released hammer for discharging the firearm.

As the slide then still continues forward as shown in FIG. 9, the shell 60 is pushed off the carrier 22 and moved into the chamber by bolt 42. Once the carrier pawl 21 is no longer beneath the slide 58, the pawl and mounting portion 22*b* of the carrier 22 behind pin 103*a* rotates upward clockwise about pivot axis 103 in direction 118, thereby forcing the front loading portion 22*a* of the carrier back down into the downward loading position under the upward biasing force of spring 104 acting on the rear end of the carrier via the pawl. The shell 60 in FIG. 9 is shown partially loaded into chamber 53 and breech is still partially open (i.e. bolt head 44 not in battery with the barrel 50.

The slide 53 continues forward so that the bolt 42 fully loads the shell 60 into the barrel chamber 53 and closes the breech, as shown in FIG. 1. The firing cycle of the action is complete and shotgun 20 is returned to the ready-to-fire condition.

Figure 12:
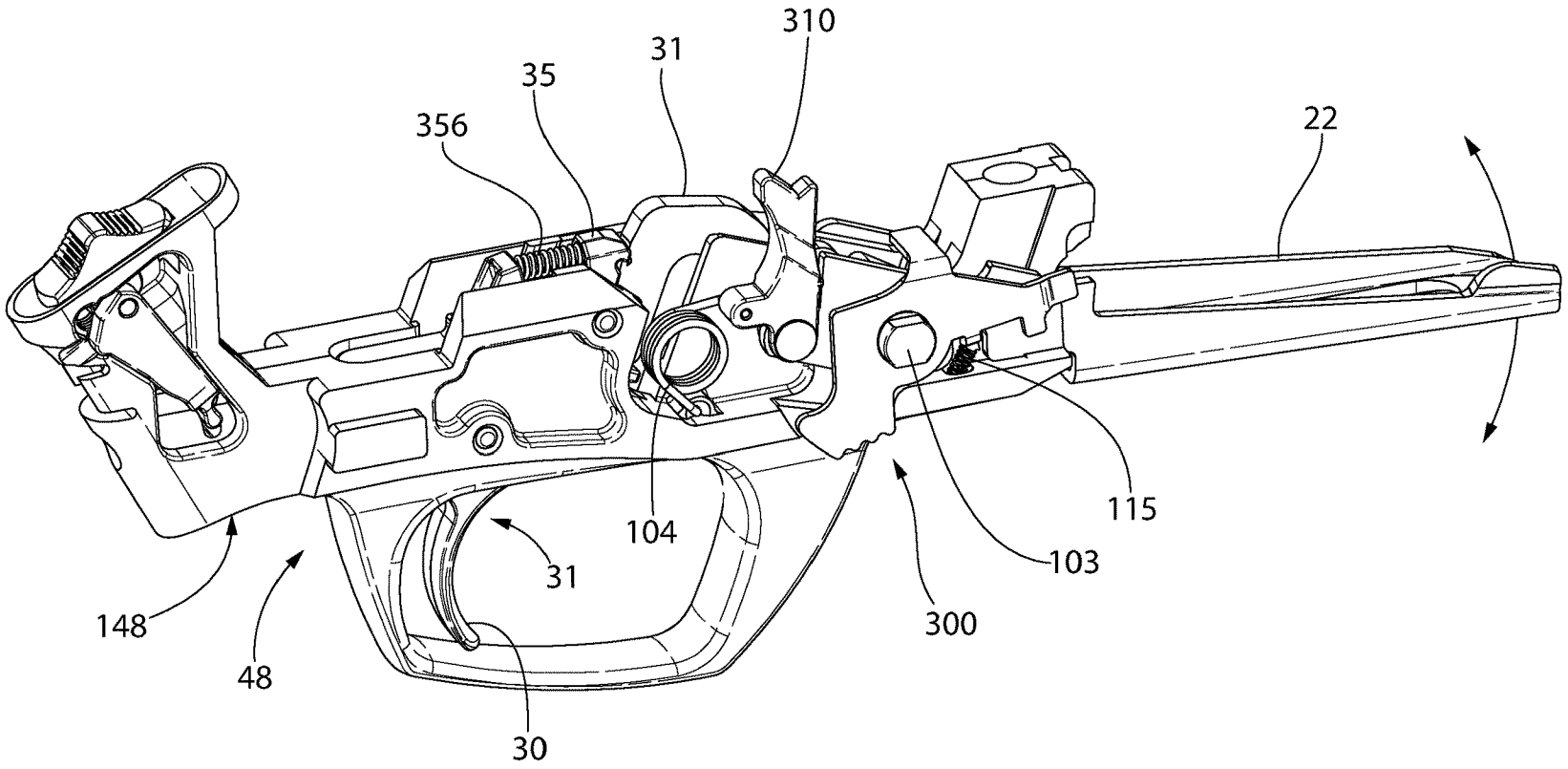
FIG. 12 is a perspective view of a second embodiment of a carrier latch disconnect and pawl that further includes a carrier anti-bounce detent mechanism.
Figure 13:
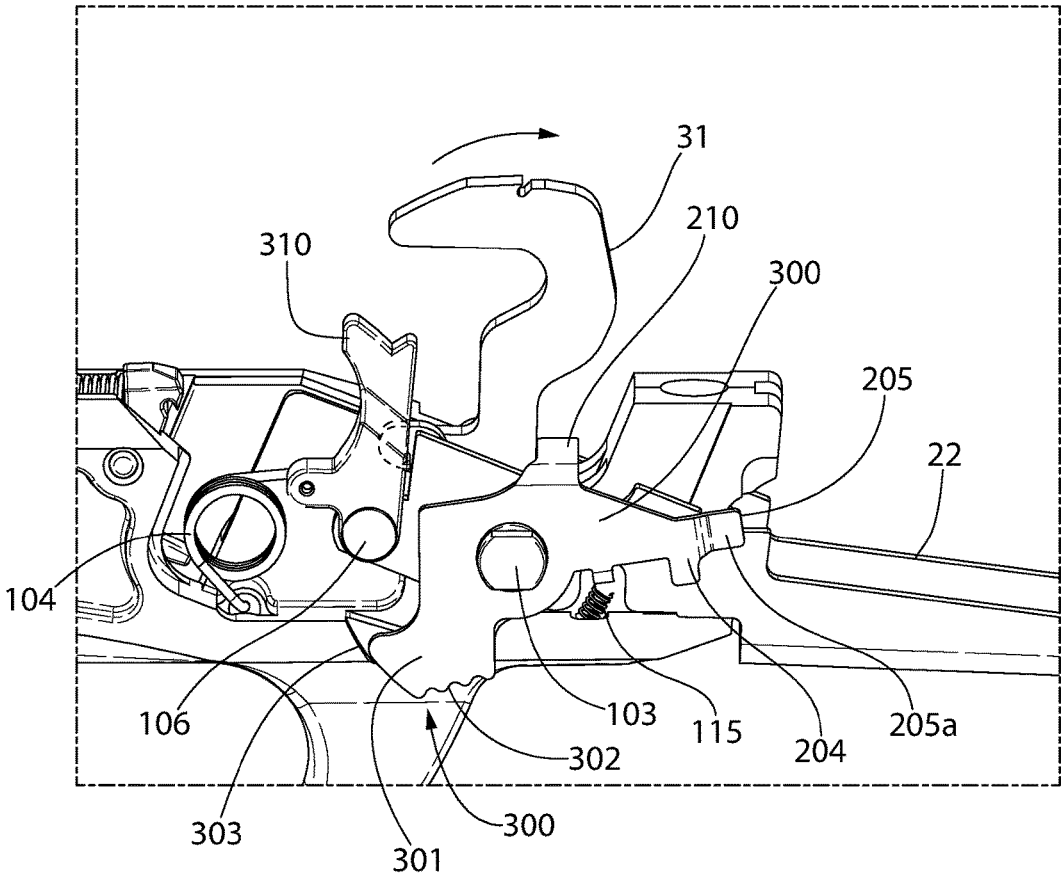
FIG. 13 is a perspective view thereof showing initial contact between the released hammer and the carrier latch disconnect with disconnect in an upward blocking position.
Figure 14:
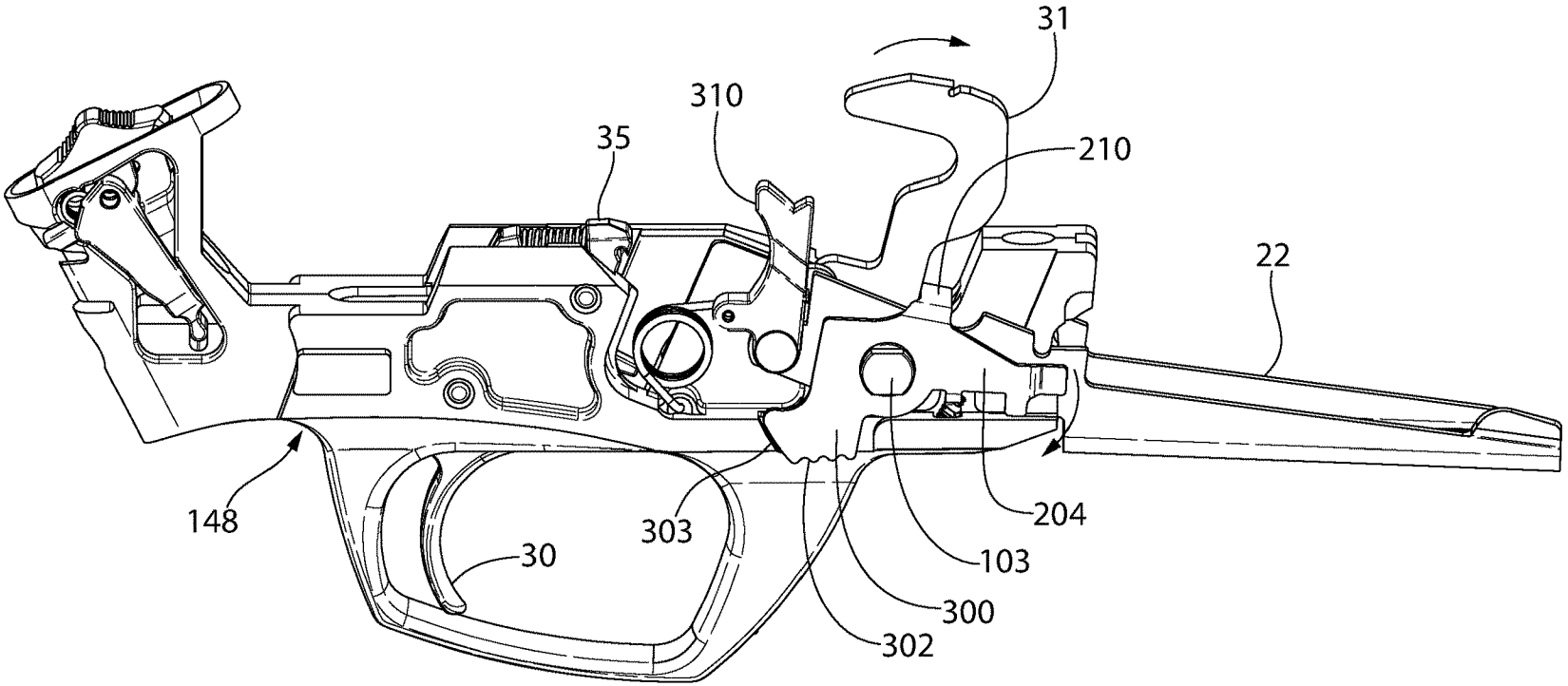
FIG. 14 is a perspective view showing full contact between the released hammer and the carrier latch disconnect with disconnect in a downward non-blocking position.
Figure 15:
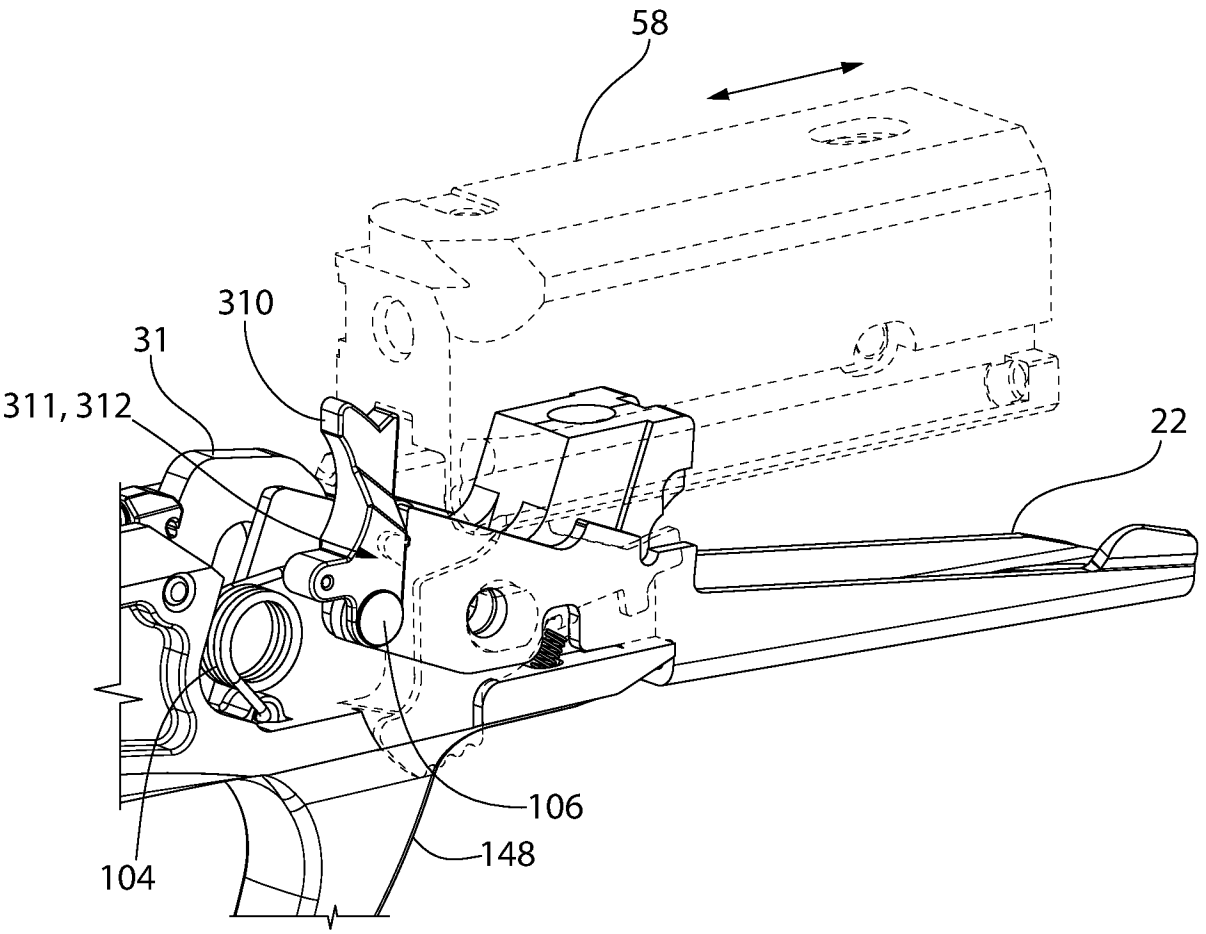
FIG. 15 is a further perspective view of the second embodiment of FIG. 12 showing the interaction of the reciprocating slide with carrier pawl.

FIGS. 12-14 show an alternative embodiment of a carrier latch disconnect. Carrier latch disconnect 300 is configured to be manually operated in contrast to carrier latch disconnect 108 described above which is automatically operated by carrier pawl 21 (see, e.g. FIGS. 1-6 and 8-11). Accordingly, in the present embodiment being described, pawl 21 is reconfigured to eliminate the forwardly extending lower leg 106 which is no longer required. Concomitantly, the corresponding rearwardly extending actuating arm 201 of the original carrier latch disconnect 108 is therefore not needed and also omitted. Other aspects and features of the new pawl 310 remain the same as pawl 21. The manual carrier latch disconnect 300 thus retains the hammer stop arm 210 which operates in the same manner described above.

Manually operated carrier latch disconnect 300 includes a downwardly extending operating protrusion 301. The lower portion 302 of the operating protrusion 301 remains exposed through a downwardly open slot 303 formed in lower receiver 48 (firing control housing 148) when disconnect 300 is mounted in the shotgun. This allows the user to manually pivot the carrier latch disconnect 300 between the upper raised blocking position (see, e.g. FIG. 5A) laterally engaged with the carrier lock protrusion 111 on the rear end 150*b* of the carrier latch 150, and the downward lowered non-blocking position (see, e.g. FIG. 5B) disengaged from carrier lock protrusion 111. In one embodiment, the lower portion 302 of operating protrusion 301 may be serrated or textured to facilitate grasping by the user's fingers to manually actuate the carrier latch disconnect.

As before, when the new carrier latch disconnect 300 is in a raised blocking position shown in FIG. 13. This figure depicts initial contact between hammer stop arm 210 on disconnect 300 and hammer 31 after being forwardly released by sear 35 following a trigger pull. The carrier latch 150 is blocked by the disconnect 300 from rotating inwards to engage and hold down the carrier as further described herein. The carrier latch disconnect 300 remains biased upwards towards the blocking position by spring 115. The operating protrusion 301 of disconnect 300 is in a downward position projecting from slot 303 as shown.

When the hammer 31 rotates fully forward to strike the firing pin, the hammer forces hammer stop arm 210 all the way forward and downward. This in turn rotates disconnect 300 and pivots the forward end of the disconnect downward to the non-blocking position shown in FIG. 14. Downward motion of the disconnect 300 is arrested by engagement between the front blocking portion 204 of the disconnect (e.g. downwardly extending protrusion) and a horizontal surface of the firing control housing 148. This allows the carrier latch 150 to rotate inwards to lock the carrier 22 down for receiving a new shell from magazine 80 in the manner previously described herein. The non-blocking position of carrier latch disconnect 300 compresses spring 115. The operating protrusion 301 of disconnect 300 is in a pivoted upward position now at least partially retracted upwards into slot 303 as shown The remaining parts of carrier latch disconnect 300 including forward portions which engage the carrier latch 150 (e.g. front blocking portion 204 with front blocking surface 205*a*) are unchanged and identical to carrier latch disconnect 108 as already described above. These parts will therefore not described here for the sake of brevity.

In the present embodiment, it bears noting that the lower receiver 48 is still configured as before to serve as a firing control housing 148 already described above and shown for example in FIGS. 1-4 and 10-11. Thus the lower receiver or firing control housing (terms used synonymously herein) supports the firing mechanism and shell loading system components described herein.

The main purpose of the manual disconnect 300 is the ability to release a round from the chamber, leaving the remaining rounds in the magazine. This operation is preformed simply by pulling the slide 58 assembly back and removing the round from the chamber, rendering the firearm safe. The "safe" condition could be used to cross a fence or hazardous obstacle in the field. The method for removing the rounds from the magazine is to pull back on the shell stop button (carrier latch operating button 120) in a rearward motion while the carrier is depressed and raised by the user to an upward location, allowing the shells to feed out of the magazine. Once the magazine is cleared of all its shells, the manual disconnect 300 can be depressed to lock the slide assembly back to an open port condition. To remove the round in the chamber with the prior fully automatic disconnect 108 previously described, by contrast, the slide assembly is pulled back to remove the chambered round. This action releases the rounds automatically from the magazine until the entire magazine is cleared.

According to another aspect of the present invention, a carrier anti-bounce detent mechanism is provided which is depicted in FIGS. 14-20. As described herein, the shotgun comprises a laterally movable carrier latch 150 that engages the carrier 22 and holds it down after each shot (to receive a new shell from the tubular magazine). If the carrier is bouncing, the latch does not have time to engage the carrier properly resulting in ammunition feeding jams when shells released from the magazine. This carrier bounce condition may occur during rapid firing succession scenario. For example, after the carrier is in the raised or upright position to chamber a new shell via the forward moving slide after discharging the shotgun, the carrier on its way to the downward or at rest position hits a stop surface causing the carrier to bounce up/down numerous times. If the trigger is quickly pulled again by the user for a quick followup shot before the carrier stops bouncing, the next shell released from the magazine during the firing sequence encounters the bouncing carrier which is out of position, thereby cause an ammunition feed jam. The present detent mechanism dampens this carrier bounce rapidly to allow the next round from the magazine to feed properly onto the carrier for the quick follow up shot. Accordingly, the benefit and purpose of this detent mechanism is therefore to restrain the carrier of the shotgun from bouncing after firing of the shotgun, thereby eliminating shell loading jams and allowing quick followup shots.

Figure 16:
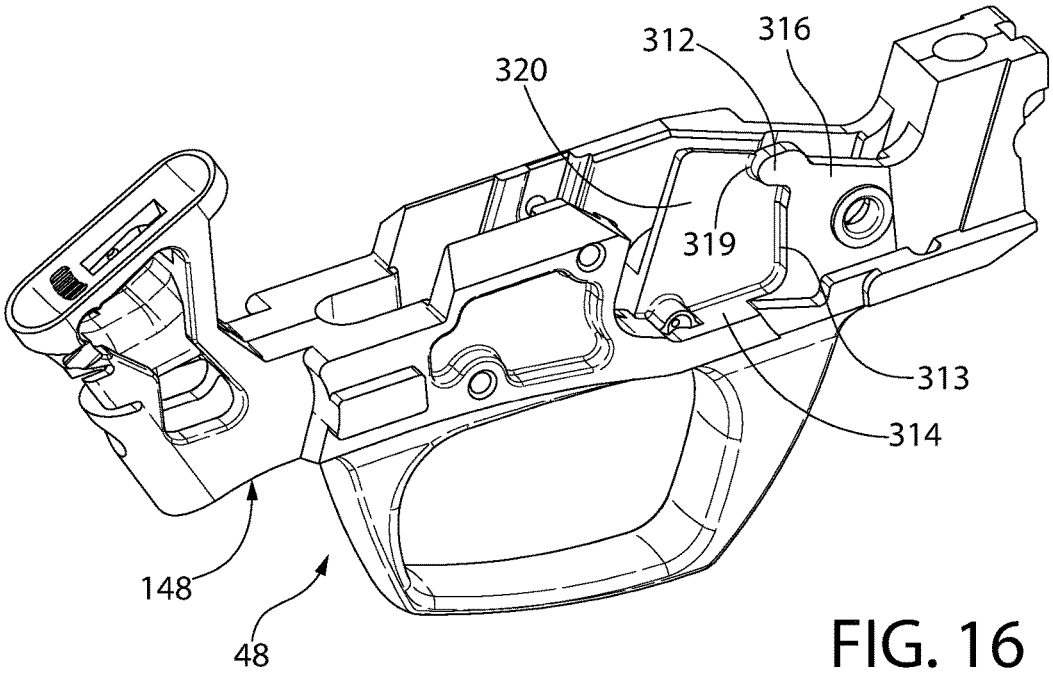
FIG. 16 is a perspective view of the lower receiver including a first detent feature of the detent mechanism.
Figure 17:
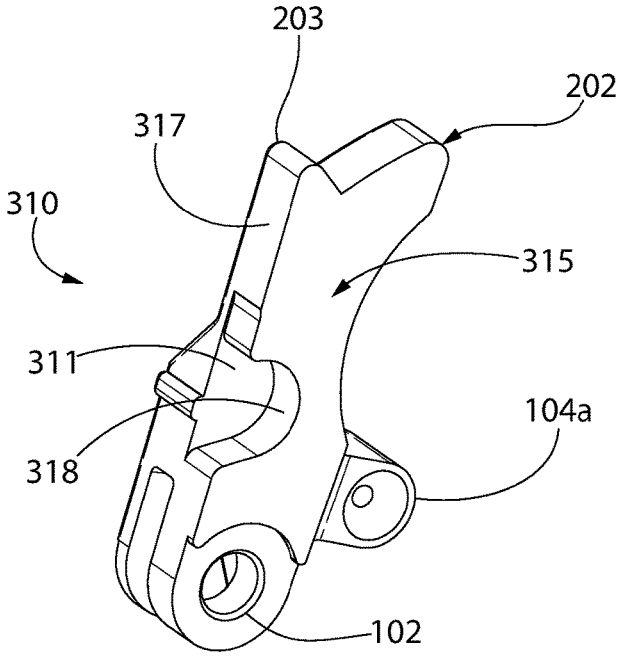
FIG. 17 is a perspective view of the pawl showing a second detent feature of the detent mechanism.

Referring now to FIGS. 14-20, the anti-bounce detent mechanism in one embodiment includes mating releasable locking surfaces (detent features) which may comprise a detent pocket or slot 311 formed in the carrier pawl 310 which is selectively engaged by a complementary configured detent protrusion 312 formed on the firing control housing (i.e. lower receiver 48), or vice-versa. As best shown in FIGS. 16 and 17, detent slot 311 may be formed on an inward facing side or lateral surface 315 of pawl 310 and detent protrusion 312 may be formed on a mating outward facing side or lateral surface 316 of the firing control housing. In the illustrated embodiment, detent slot is formed on the left facing lateral surface 315 of the pawl 310 and detent protrusion 312 is formed on the right facing lateral surface 316 of the firing control housing.

Detent slot 311 is inwardly and laterally open as well as forwardly open. In one embodiment, the detent slot 311 may be formed proximate to and adjoining the front side 317 of pawl 310. Slot 311 may therefore interrupt and penetrate the front surface of the pawl 310 forming a forwardly open cavity or depression defined by arcuately curved sidewalls 318. Sidewalls 318 extend contiguously along the top, bottom and through the rear of the slot forming a contiguous recesses surface along which as shown. Slot 311 may be located in the central or middle portion of the pawl 310 between the top and bottom ends as shown.

Detent protrusion 312 on the firing control housing is complementary configured to the detent slot 311 on pawl 310. The protrusion 312 is thus configured and dimensioned to slideably fit within the detent slot 311 and be alternatingly inserted into and withdrawn from the slot during operating of the firearm action under recoil and manually, as further described herein. Detent protrusion 312, formed on the outward facing lateral or side surface 316 of the firing control housing as previously noted, is axially elongated in length. The protrusion 312 extends in a rearward direction to releasably engage the forwardly open detent slot 311 on pawl 310. In one embodiment, detent protrusion 312 may be oriented obliquely to the longitudinal axis LA of the shotgun and has a free rear end 319 which is higher than its fixed front end. This angled positioning orients the protrusion 312 to properly engage or disengage the slot 311 during operation, as further described herein.

Figure 18:
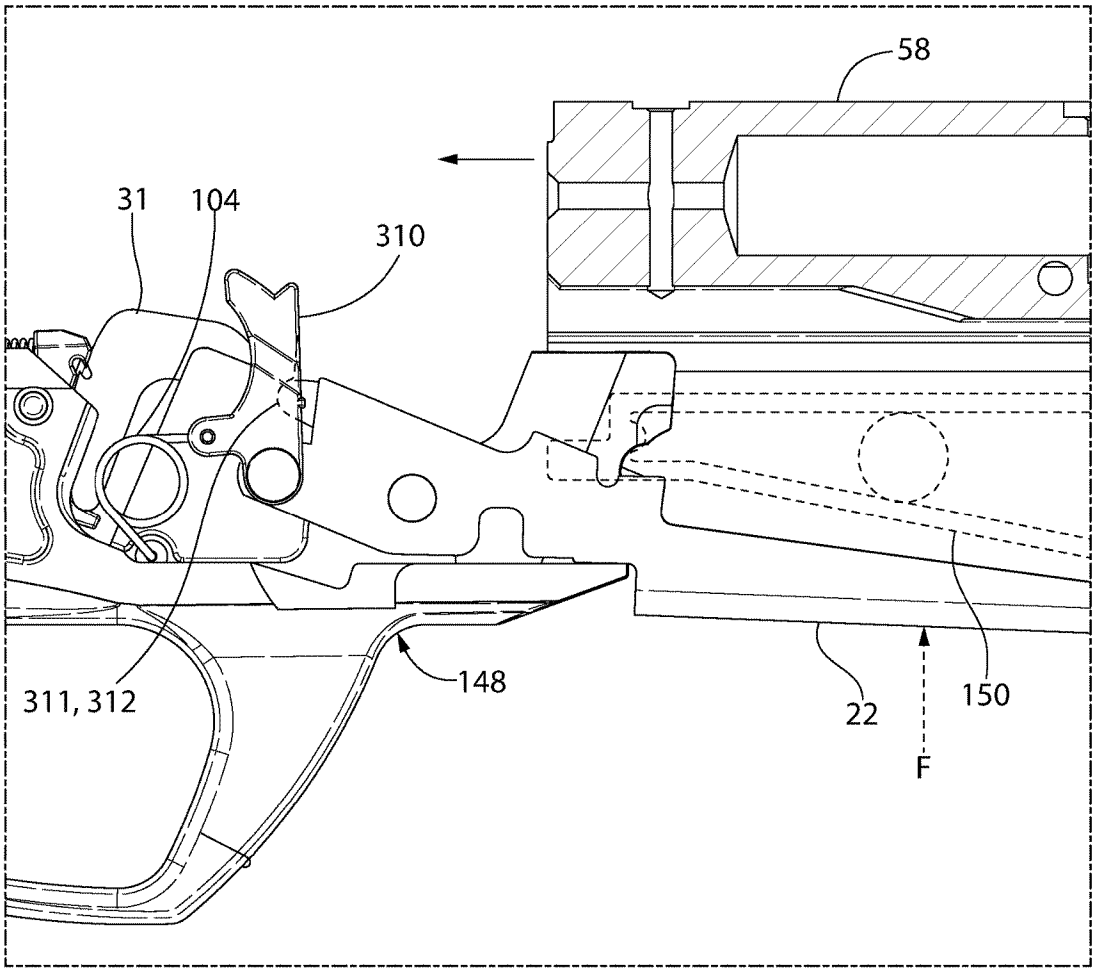
FIG. 18 is perspective view showing the action of the firearm and detent mechanism in a first position.
Figure 19:
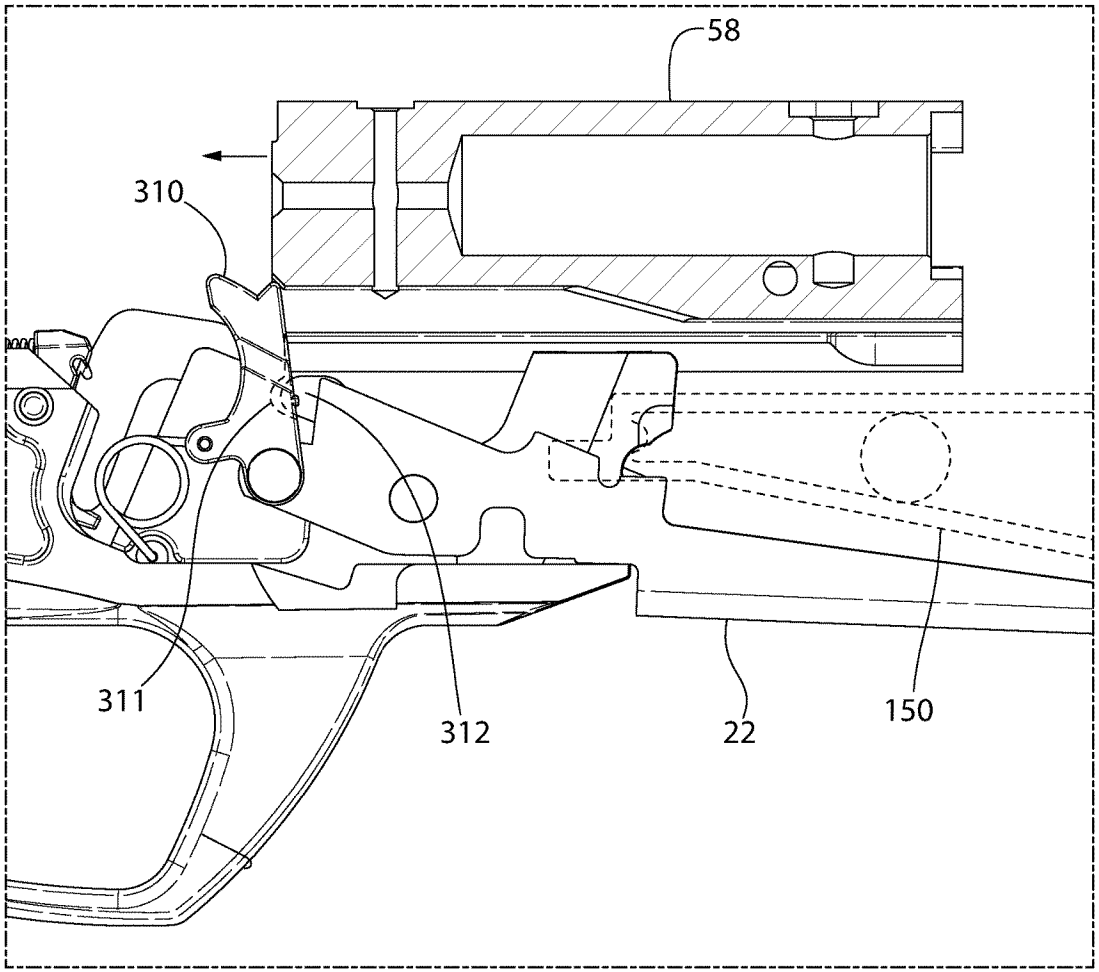
FIG. 19 is perspective view showing the action of the firearm and detent mechanism in a second position.
Figure 20:
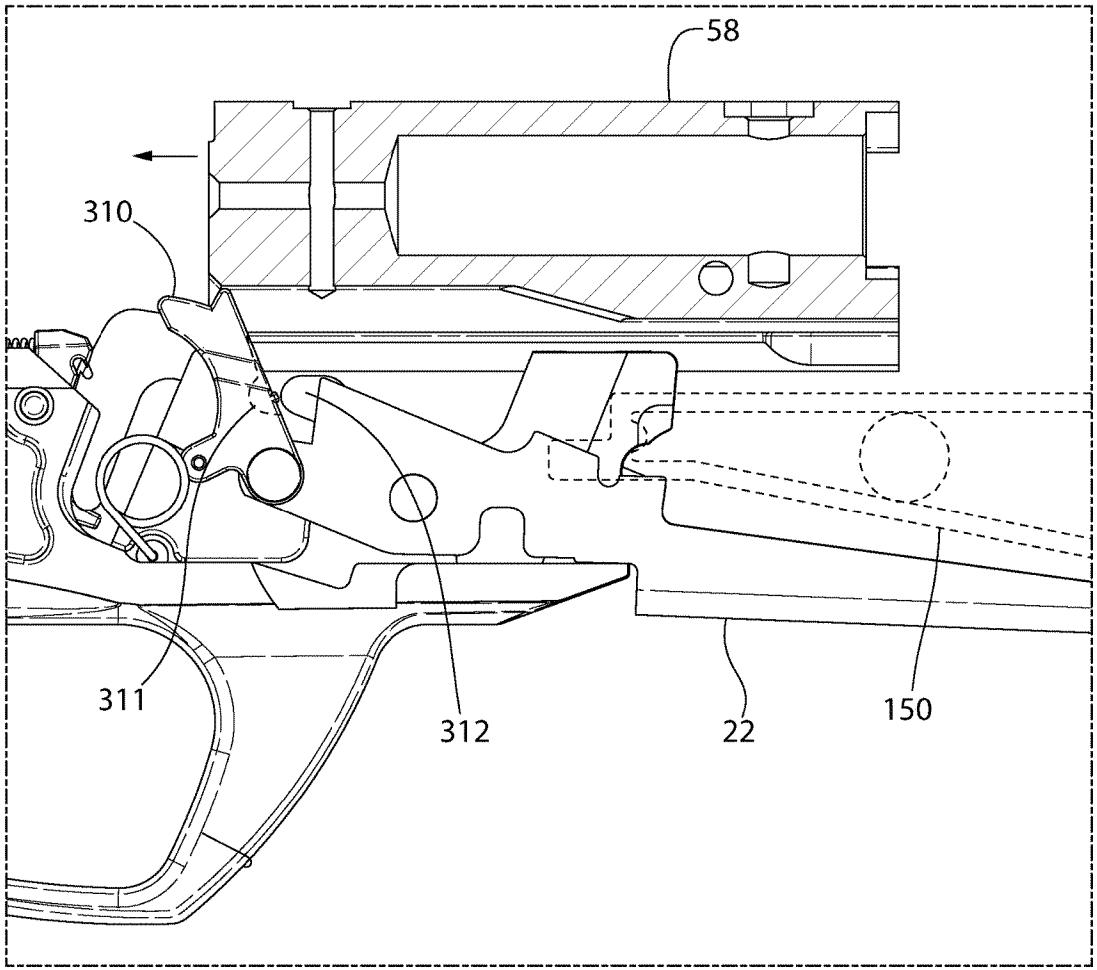
FIG. 20 is perspective view showing the action of the firearm and detent mechanism in a third position.

In one embodiment, the detent protrusion 312 may be defined as a feature in an outwardly open receptacle 320 formed on the outward facing side surface 316 of the firing control housing (best shown in FIG. 16). Receptacle 320 defines and may include a vertical front wall 313 and adjoining horizontal bottom wall 314. Detent protrusion 312 extends rearwardly from the front wall 313 of the receptacle 320 to engage the pawl detent slot 311. The receptacle 320 is rearwardly and upwardly open, and dimensioned for receiving at least part of the pawl 310 therein including the middle portion which includes the detent slot 311. Receptacle 320 is further preferably large enough to permit pivotable movement of the pawl 310 therein during it movement and operation. In one embodiment, the upper portion of pawl 310 may protrude upwards out of the receptacle 320 and beyond the top surface of the firing control housing as shown in FIGS. 18-20 to better engage the slide 58 in the manner described herein.

In some embodiments, detent protrusion 312 may be formed integrally with the firing control housing (i.e. lower receiver 48) as a unitary structural part thereof. In some embodiments, the firing control housing may be formed of cast or forged metal (e.g. steel, aluminum, titanium, etc.), or alternatively a suitably strong polymer such as a nylon reinforced plastic. In other possible embodiments, the detent protrusion 312 may be formed as a separate component which is attached to the firing control housing by any suitable means such as for example welding, brazing, adhesives, fasteners, friction or shrink fitting, etc. In such composite embodiments, for example without limitation, the firing control housing may be formed of polymer and the detent protrusion 312 may formed of a suitable metal to better resist wear because the pawl is preferably made of metal.

In some implementations, it will be appreciated that the detent slot and protrusion features may be reversed. The detent slot 311 may therefore be formed in the firing control housing instead and the detent protrusion may be formed on the pawl with the same relative positions of each described above. Functionality may therefore remain as already described herein.

A method for operating the firearm such as shotgun 20 and carrier anti-bounce detent mechanism will now be briefly described. FIGS. 18-22 show sequential steps of the action cycling under recoil and positions or states of the detent mechanism. In all these figures, the hammer 31 is shown in its reset rearward cocked position to more clearly show the interaction and cooperation between the detent protrusion 312 and detent slot 311 of the detent mechanism without obstruction from the hammer. It will be appreciated the hammer in reality would actually be released by the sear and rotated forward during firing, and then is reset and re-cocked by the rearward moving slide 58 in the manner already described above.

The carrier anti-bounce detent mechanism is movable between a locked position preventing the front loading portion 22*a* of the carrier 22 from rotating upwards, and an unlocked position allowing the front loading portion 22*a* of the carrier 22 to rotate upwards. When the slide 58 is in battery with the rear breech end of barrel 50 and the breech is closed as seen in FIG. 1, the pawl 310 is completely disengaged from the rear end of slide 158 (as also seen in FIG. 18). As also shown in FIG. 18, the detent protrusion 312 on the firing control housing is in the locked position fully engaged with the detent slot 311 on the pawl 310, thereby holding the carrier 22 in the downward position. It bears noting that spring 104 biases the detent protrusion 312 and detent slot 311 into this fully engaged position when the pawl 310 is not engaged and rotated by the slide 158. Pawl 310 may be completely upright and substantially vertical in orientation as shown. Hammer 31 is restrained by sear 35 in rearward cocked position. The firearm is thus readied for firing with the action in the ready-to-fire position.

After the trigger pull, the hammer 31 is released and rotates forward in the manner previously described herein. The hammer 31 makes initial contact with the hammer lateral stop arm 210 on carrier latch disconnect 300, as shown in FIG. 13 (see directional arrow). The hammer 41 then continues to rotate fully forward to strike and drive the firing pin 41 axially forward to detonate the chambered shell 60. Contact between the hammer 31 and hammer stop arm 210 pivots the upwardly biased carrier latch disconnect 300 fully downwards in a manner similar to that described above and shown in FIGS. 13 and 14. This releases the carrier latch 150 to allow its rear end 150*b* to swing inwards and engage the carrier 22 locking it in the downward position (as previously described herein) in combination with the detent mechanism. The mutually engaged detent slot 311 and detent protrusion 312 of the carrier anti-bounce detent mechanism assists the carrier latch 150 in restraining the carrier, but is not the primary mechanism for that purpose. As the rear end 150*b* of carrier latch 150 pivots inwards, the forward end 150*b* with shell stop 152 simultaneously pivots outward to release a new shell from magazine 80 onto the carrier 22. The rear of the shell contacts the carrier latch 150 when the shell moves onto the carrier 22 thus pivoting the rear end 150*a* of carrier latch 150 back outwards.

FIG. 19 shows the shotgun immediately after firing with the slide 58 beginning its travel rearward under recoil and opening the breech. During the rearward travel of the slide 58, the slide engages and rotates carrier pawl 310 rearward and downward its pivot axis 102. This situation causes no significant drag on the slide which could cause a loss of power in the inertia reloading system of the shotgun. The detent slot 311 begins to partially disengage the detent protrusion 312 as shown to allow normal operation of the pawl 310 as previously described herein. As the slide 58 continues rearward, the pawl 310 rides underneath the slide and further rotates downward/rearward to eventually completely disengage the detent slot 311 from the detent protrusion 312, as shown in FIG. 20. A new shell already dispensed from magazine 80 and seated on the carrier 22 is then uploaded into the action by raising the carrier via interaction between the pawl 310 and slide 58, in the same manner previously described herein.

In the foregoing operating sequence described immediately above, it bears noting that the carrier latch disconnect 300 rotates back upward into a blocking position preventing the carrier latch 150 from swinging back inwards to relock the carrier 22 down when the shell previously positioned on the carrier is uploaded into the action. This occurs when the underside of the slide engages and cocks/resets the hammer during the slide's rearward travel. The upward biasing force of spring 115 returns the carrier latch disconnect 300 to the blocking position without the hammer 21 in its fully forward position forcing the hammer stop arm 210 on carrier latch disconnect 300 down.

Figure 21:
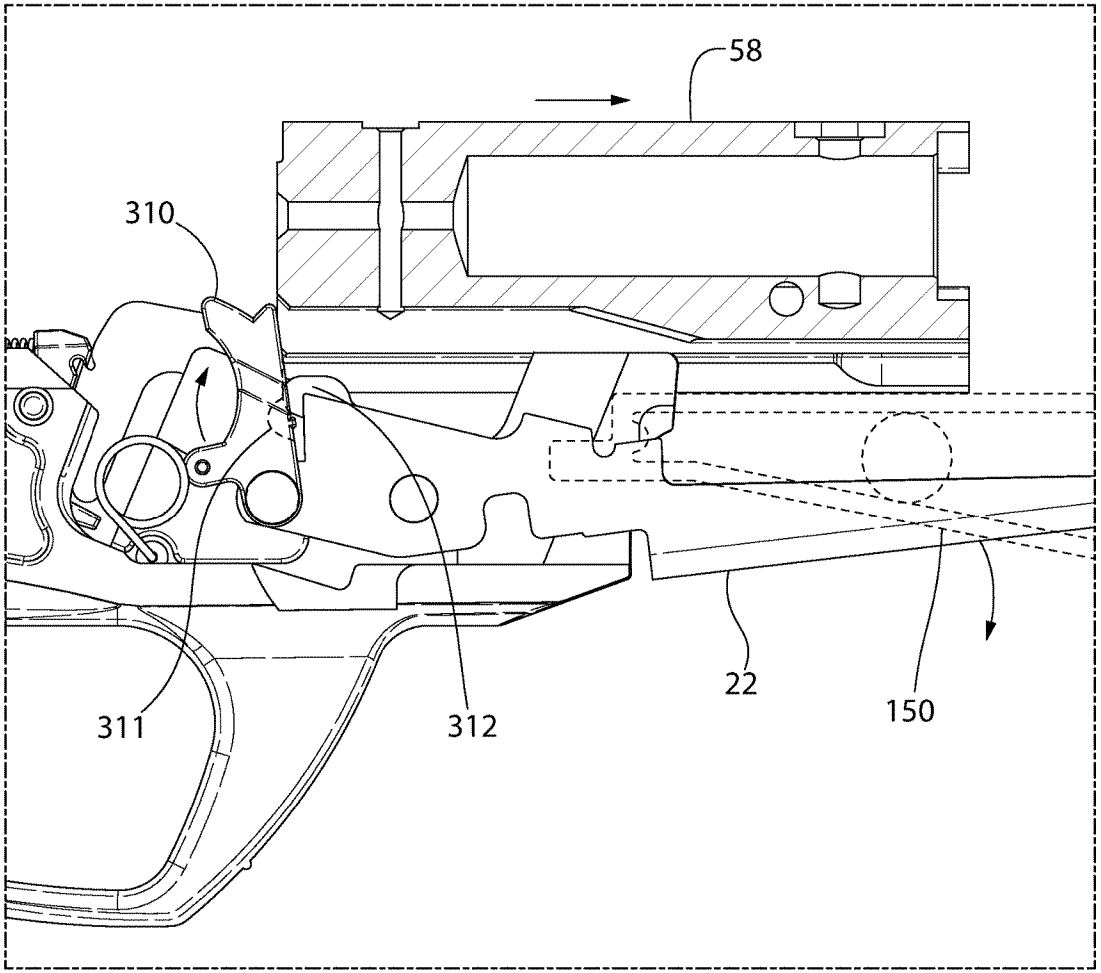
FIG. 21 is perspective view showing the action of the firearm and detent mechanism in a fourth position.
Figure 22:
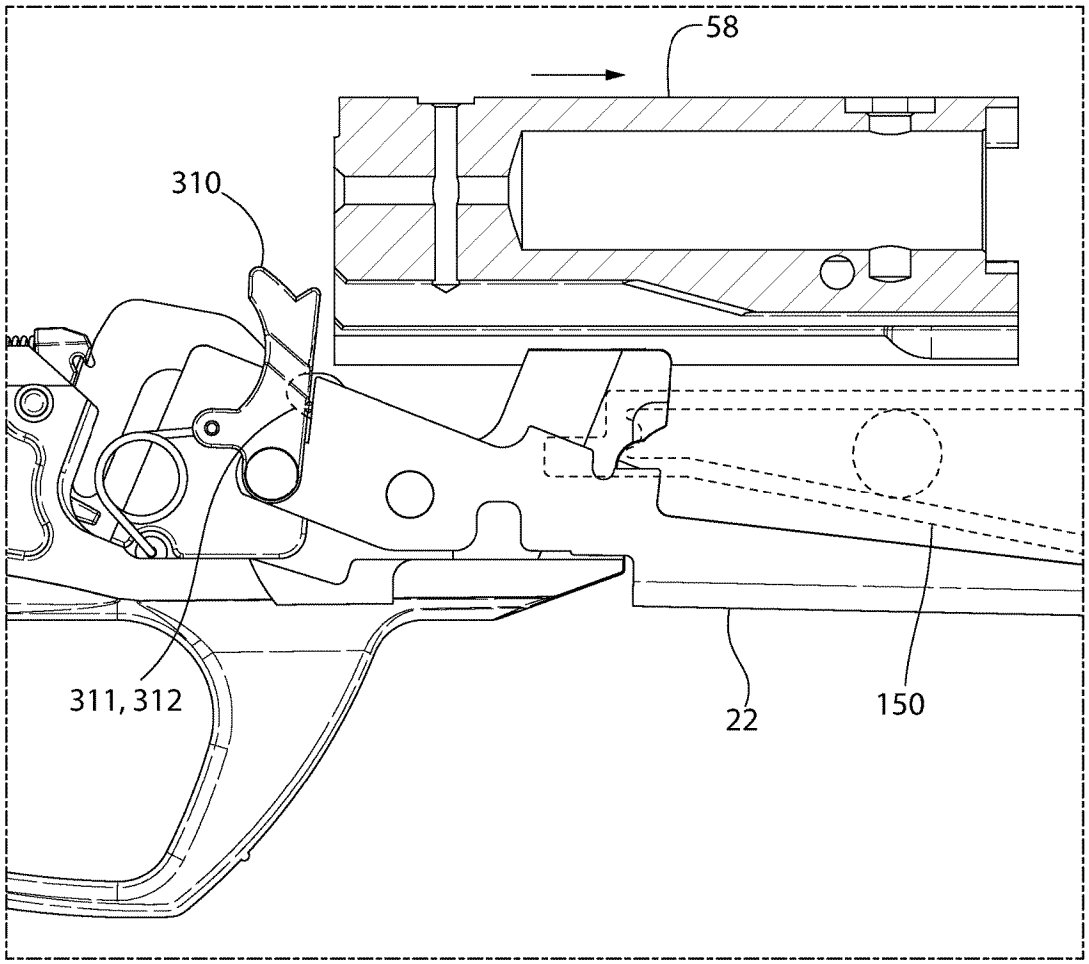
FIG. 22 is perspective view showing the action of the firearm and detent mechanism in a fifth position.

FIG. 21 shows the slide 58 now traveling back forward under the force of the recoil springs 59. The pawl 310 is show just after breaking contact with the underside of the slide 58. Spring 104 biases and returns the pawl back towards its upright position as indicated without contact from the slide 58. The detent slot 311 is shown beginning to re-engage detent protrusion 312 on the firing control housing 148 as the carrier 22 rotates back downward about pivot axis 103 from its tilted upward position (from uploading the new shell into the action which is chambered by the forward traveling bolt 42). This downward motion of the carrier front loading portion 22*a* concomitantly raises the rear portion 22*b* of the carrier 22 to lift the pawl 310 and horizontally re-align the pawl detent slot 311 with detent protrusion 312 on firing control housing 148. Continued forward rotation of the pawl 310 will fully re-engage the detent slot 311 with detent protrusion 312 as the breech closes (see FIG. 22) while the dropping carrier 22 contacts a stop surface on the firing control housing and is susceptible to the bounce phenomenon previously described. Advantageously, the detent mechanism in the fully engaged locked position arrests the carrier to prevent bounce. This allows the user to make a quick trigger pull and followup shot while the detent mechanism ensures that the next shell released from the magazine will encounter the carrier in the proper downward position for receiving the shell.

According to another notable function provided by the carrier anti-bounce detent mechanism, the detent slot 311 is releasably engaged with the detent protrusion 312 when the slide 58 is forward in the closed breech position shown in FIG. 18. If the user wishes to load additional shells 60 into the magazine 80 with the slide fully forward, for example, an upward pressure force F may be applied against the underside of the carrier 22 by the user as indicated with a shell or fingers. This at least partially or fully withdraws the detent protrusion 312 from the detent slot 311 automatically, thereby allowing the carrier 22 to be raised upwards and out of the way for access to load or remove shells into/from the magazine 80. Raising the carrier 22 will thus slightly rotate the pawl 310 rearward and backward to achieve the partial or full disengagement of the detent protrusion 312 from slot 311. Accordingly, the detent mechanism can be at least partially disengaged to operate the carrier in the normal manner with the slide fully forward and the breech closed. Because the carrier 22 is biased into the downward position by torsion spring 104, removing the pressure force F from the carrier 22 automatically lowers the carrier 22 and fully re-engages the detent protrusion 312 with the detent slot 311 (see, e.g. FIG. 18).

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A shell loading system for a firearm, the system comprising:
   - a barrel defining a longitudinal axis and a chamber configured to hold a shell;
   - a receiver coupled to the barrel and comprising a firing control housing supporting a trigger-actuated firing mechanism operable to discharge the firearm;
   - an axially reciprocating slide disposed in the receiver and movable between forward and rearward positions;
   - a bolt carried by the slide and axially aligned with the barrel for forming a closed breech;
   - a magazine configured to retain and feed a plurality of shells into the receiver;
   - a carrier assembly comprising:
     - a carrier pivotably mounted in the receiver and positioned to receive a shell from the magazine, the carrier movable between a downward loading position for receiving shells from the magazine and upward feeding position for chambering the shells;
     - a pawl pivotably mounted to the carrier and positioned to engage the slide;
   - a first detent feature disposed on the firing control housing configured to selectively and slideably engage a second detent feature disposed on the carrier assembly;
   - wherein the first and second detent features are fully engaged when the slide is in the forward position and releasably restrain the carrier in the downward loading position.

2. The shell loading system according to claim 1, wherein the first and second detent features are disengaged when the slide is in the rearward position allowing the carrier to move from the downward loading position to the upward feeding position.

3. The shell loading system according to claim 2, wherein the first detent feature is one of a detent protrusion or detent slot and the second detent feature is the other of the detent protrusion or detent slot.

4. The shell loading system according to claim 3, wherein the second detent feature is a forwardly open detent slot formed on the carrier assembly and the first detent feature is a rearwardly extending detent protrusion formed on the firing control housing.

5. The shell loading system according to claim 3, wherein the detent protrusion is inserted in the detent slot when the slide is in the forward position, and removed from the detent slot when the slide is in the rearward position.

6. The shell loading system according to claim 4, wherein the detent protrusion is formed on a lateral side of the firing control housing.

7. The shell loading system according to claim 4, wherein the detent slot is formed on the pawl.

8. The shell loading system according to claim 7, wherein the pawl is movably received in a laterally open recess in the firing control housing, the detent protrusion on the firing control housing extending into the recess to engage the detent slot in the pawl.

9. The shell loading system according to claim 7, wherein when the slide moves to the rearward position, the slide engages and rotates the pawl downwards to disengage the detent slot in the pawl from the detent protrusion on the firing control housing.

10. The shell loading system according to claim 4, wherein the detent protrusion is releasable from the detent slot when the slide is in the forward position via manually moving the carrier from the downward loading position to the upward feeding position, thereby allowing shells to be loaded into the magazine with the slide in the forward position with a closed breech.

11. The shell loading system according to claim 4, wherein the detent protrusion is longitudinally positioned between a first pivot pin that mounts the carrier to the firing control housing and a second pivot pin that mounts the pawl to a rear portion of the carrier.

12. The shell loading system according to claim 11, wherein the detent protrusion is disposed above the first and second pivot pins.

13. A shell loading system for a firearm, the system comprising:

a barrel defining a longitudinal axis and rear breech end defining a chamber configured to hold a shell;

a receiver coupled to the barrel and supporting a trigger-actuated firing mechanism operable to discharge the firearm;

an axially reciprocating slide disposed in the receiver and movable between forward and rearward positions;

a magazine configured to retain and feed a plurality of shells into the receiver;

a carrier pivotably mounted in the receiver, the carrier movable between a downward loading position for receiving the shells from the magazine and upward feeding position for chambering the shells with the slide;

a pawl pivotably mounted to the carrier and positioned to engage the slide; and a carrier anti-bounce detent mechanism comprising a stationary first detent feature disposed on the receiver and a movable second detent feature disposed on the pawl, the first detent feature selectively engageable with the second detent feature;

wherein rotating the pawl in a first direction disengages the first and second detent features, and rotating the pawl in a second direction mutually engages the first and second detent features.

14. The shell loading system according to claim 13, wherein: the first and second detent features are fully engaged when the slide is in the forward position which releasably restrains the carrier in the downward loading position; and the first and second detent features are at least partially disengaged when the slide is in the rearward position.

15. The shell loading system according to claim 14, wherein the first detent feature is one of a detent protrusion or detent slot and the second detent feature is the other of the detent protrusion or detent slot.

16. The shell loading system according to claim 15, wherein the second detent feature is a forwardly open detent slot formed on the pawl and the first detent feature is a rearwardly extending detent protrusion formed on the firing control housing.

17. A method for operating a shotgun with carrier detent mechanism, the method comprising:

providing a shotgun including a barrel, a receiver, a reciprocating slide aligned with the barrel and axially movable into and out of battery with the barrel respectively, a tubular magazine containing a shell, a shell carrier assembly axially aligned with the magazine and pivotably movable between downward and upward positions, and a carrier detent mechanism movable to selectively engage or disengage the carrier assembly;

firstly moving the slide to a forward closed breech position in battery with the barrel;

mutually engaging a first detent feature on the receiver with a second detent feature on the carrier assembly, the engaged first and second detent features releasably holding the carrier assembly in the downward position; and secondly moving the slide to a rearward open breech position, the slide acting on the carrier assembly to disengage the second detent feature from the first detent feature on the receiver, the disengaged first and second detent features allowing the carrier to move from the downward position to the upward position.

18. The method according to claim 17, further comprising a pawl including the second detent feature and rotatably mounted on the carrier assembly, wherein the secondly moving step comprises the slide engaging and rotating a pawl to disengage the first and second detent features.

19. The method according to claim 18, wherein the second detent feature is an axially open detent slot on the pawl and the first detent feature is a detent protrusion formed on the receiver.

20. The method according to claim 17, wherein when the slide is in the forward closed breech position, the method further comprising steps of applying an upward force on an underside of the carrier, moving the carrier assembly to the upward position, and at least partially disengaging the first detent feature from the second detent feature.

* * * * *